US006243476B1

(12) United States Patent
Gardner

(10) Patent No.: US 6,243,476 B1
(45) Date of Patent: Jun. 5, 2001

(54) METHOD AND APPARATUS FOR PRODUCING BINAURAL AUDIO FOR A MOVING LISTENER

(75) Inventor: William G. Gardner, Arlington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 08/878,221

(22) Filed: Jun. 18, 1997

(51) Int. Cl.[7] ..... H04R 5/02
(52) U.S. Cl. ..... 381/303; 381/17; 381/1
(58) Field of Search ..... 381/1, 309, 310, 381/17, 303

(56) References Cited

U.S. PATENT DOCUMENTS

| | | | | |
|---|---|---|---|---|
| 3,236,949 | | 2/1966 | Atal et al. | 179/1 |
| 3,920,904 | | 11/1975 | Blauert et al. | 179/1 |
| 3,962,543 | | 6/1976 | Blauert et al. | 179/1 |
| 4,118,599 | | 10/1978 | Iwahara et al. | 179/1 |
| 4,119,798 | | 10/1978 | Iwahara | 179/1 |
| 4,192,969 | | 3/1980 | Iwahara | 179/1 |
| 4,219,696 | | 8/1980 | Kogure et al. | 179/1 |
| 4,308,423 | | 12/1981 | Cohen | 179/1 |
| 4,309,570 | | 1/1982 | Carver | 179/1 |
| 4,355,203 | | 10/1982 | Cohen | 179/1 |
| 4,731,848 | | 3/1988 | Kendall et al. | 381/63 |
| 4,739,513 | | 4/1988 | Kunugi et al. | 381/103 |
| 4,748,669 | | 5/1988 | Klayman | 381/1 |
| 4,817,149 | * | 3/1989 | Myers | 381/1 |
| 4,910,779 | | 3/1990 | Cooper et al. | 381/26 |
| 4,975,954 | * | 12/1990 | Cooper et al. | 381/26 |
| 5,023,913 | | 6/1991 | Matsumoto et al. | 381/63 |
| 5,034,983 | | 7/1991 | Cooper et al. | 381/25 |
| 5,046,097 | | 9/1991 | Lowe et al. | 381/17 |
| 5,105,462 | | 4/1992 | Lowe et al. | 381/17 |
| 5,136,651 | | 8/1992 | Cooper et al. | 381/25 |
| 5,173,944 | | 12/1992 | Begault | 381/17 |
| 5,208,860 | | 5/1993 | Lowe et al. | 381/17 |
| 5,333,200 | | 7/1994 | Cooper et al. | 381/1 |
| 5,337,363 | * | 9/1994 | Platt | 381/17 |
| 5,438,623 | | 8/1995 | Begault | 381/17 |
| 5,452,359 | * | 9/1995 | Inanaga et al. | 381/25 |
| 5,467,401 | * | 11/1995 | Nagamitsu et al. | 381/63 |

OTHER PUBLICATIONS

Kotorynski, "Digital Binaural/Stereo Conversion and Crosstalk Cancelling", Proc. Audio Eng. Soc. Conv., Preprint 2949 (1990).
Schroeder et al., *IEEE Int. Conv. Rec.* 7:150–155 (1963).
Sakamoto et al., *J. Aud. Eng. Soc.* 29:794–799 (1981).
Cooper et al., *J. Aud. Eng. Soc.* 37:3–19 (1989).
Damake, *J. Acoust. Soc.* 1109–1115 (1971).
Moller, *Applied Acoustics* 36:171–218 (1992).

* cited by examiner

*Primary Examiner*—Forester W. Isen
*Assistant Examiner*—B. T. Pendleton
(74) *Attorney, Agent, or Firm*—Testa, Hurwitz & Thibeault, LLP

(57) ABSTRACT

A system for generating loudspeaker-ready binaural signals comprises a tracking system for detecting the position and, preferably, the angle of rotation of a listener's head; and means, responsive to the head-tracking means, for generating the binaural signal. The system may also include a crosstalk canceller responsive to the tracking system, and which adds to the binaural signal a crosstalk cancellation signal based on the position (and/or the rotation angle) of the listener's head. The invention may also address the high-frequency components not generally affected by the crosstalk canceller by considering these frequencies in terms of power (rather than phase). By implementing the compensation in terms of power levels rather than phase adjustments, the invention avoids the shortcomings heretofore encountered in attempting to cancel high-frequency crosstalk.

42 Claims, 13 Drawing Sheets

METHOD AND APPARATUS FOR PRODUCING BINAURAL AUDIO FOR A MOVING LISTENER

BACKGROUND OF THE INVENTION

Three-dimensional audio systems create an "immersive" auditory environment, where sounds can appear to originate from any direction with respect to the listener. Using "binaural synthesis" techniques, it is currently possible to deliver three-dimensional audio scenes through a pair of loudspeakers or headphones. Using loudspeakers involves greater complexity due to interference between acoustic outputs that does not occur with headphones. Consequently, a loudspeaker implementation requires not only synthesis of appropriate directional cues, but also further processing of the signals so that, in the acoustic output, sounds that would interfere with the spatial illusion provided by these cues are canceled. Existing systems require the listener to assume a fixed position with respect to the loudspeakers, because the cancellation functions correctly only in this orientation. If the listener moves outside a narrow equalization zone or "sweet spot," the illusion is lost.

It is well known that directional cues are embodied in the transformation of sound pressure from the free field to the ears of a listener; see Jens Blauert, *Spatial Hearing* (1983). A "head-related transfer function" (HRTF) represents a measurement of this transformation for a specific sound location relative to the listener's head, and describes the diffraction of sound by the torso, head, and external ear (pinna). Consequently, a pair of HRTFs, based on a known or assumed spatial location of the sound source, process sound signals so they appear to the listener to emanate from the source location—that is, the HRTFs produce a "binaural" signal.

It is straightforward to synthesize directional cues by convolving a sound with the appropriate HRTFs, thereby creating a synthetic binaural signal. When this is done using HRTFs designed for a particular listener, localization performance essentially matches free-field listening; see Wightman et al., *J. Acoust. Soc. Am.* 85(2):858–867 and 868–878 (1989). The use of non-individualized HRTFs-that is, HRTFs designed generically and not for a particular listener—results in poorer localization performance, particularly regarding front-back confusion and elevation judgments; see Wenzel et al., *J. Acoust. Soc. Am.* 94(1):111–123 (1993).

The sound travelling from a loudspeaker to the listener's opposite ear is called "crosstalk," and results in interference with the directional components encoded in the loudspeaker signals. That is, for each ear, sounds from the contralateral speaker will interfere with binaural signals from the ipsilateral speaker unless corrective steps are taken. Loudspeaker-based binaural systems, therefore, require crosstalk-cancellation systems. Such systems typically model sound emanating from the speakers and reaching the ears is using transfer functions; in particular, the transfer functions from two speakers to two ears form a 2×2 system transfer matrix. Crosstalk cancellation involves pre-filtering the signals with the inverse of this matrix before sending the signals to the speakers; in this way, the contralateral output is effectively canceled for each of the listener's ears.

Crosstalk cancellation using non-individualized head models (i.e., HRTFs) is only effective at low frequencies, where considerable similarity exists between the head responses of different individuals (since at low frequencies the wavelength of sound approaches or exceeds the size of a listener's head). Despite this limitation, existing crosstalk-cancellation systems are quite effective at producing realistic three-dimensional sound images, particularly for laterally located sources. This is because the low-frequency interaural phase cues are of paramount importance to sound localization; when conflicting high- and low-frequency localization cues are presented to a subject, the sound will usually be perceived at the position indicated by the low-frequency cues (see Wightman et al., *J. Acoust. Soc. Am.* 91(3):1648–1661 (1992)). Accordingly, the cues most critical to sound localization are the ones most effectively treated by crosstalk cancellation.

Existing crosstalk-cancellation systems usually assume a symmetric listening situation, with the listener located directly between the speakers and facing forward. The assumption of symmetry leads to simplified implementations, such as the shuffler topology described in Cooper et al., *J. Audio Eng Soc.* 37(1/2):3–19 (1989). One can compensate for a laterally displaced listener by delaying and attenuating one of the output channels (see U.S. Pat. Nos. 4,355,203 and 4,893,342). It is also possible to reformat the loudspeaker signals for different loudspeaker spread angles, as described, for example, in the '342 patent. It has not, however, been possible to maintain a binaural signal for a moving listener, or even for one whose head rotates.

SUMMARY OF THE INVENTION

The present invention extends the concept of three-dimensional audio to a moving listener, allowing, in particular, for all types of head motions (including lateral and frontback motions, and head rotations). This is accomplished by tracking head position and incorporating this parameter into an enhanced model of binaural synthesis.

Accordingly, in a first aspect, the invention comprises a tracking system for detecting the position and, preferably, the angle of rotation of a listener's head; and means for generating a binaural signal for broadcast through a pair of loudspeakers, the acoustical presentation being perceived by the listener as three-dimensional sound—that is, as emanating from one or more apparent, predetermined spatial locations. In particular, the system includes a crosstalk canceller that is responsive to the tracking system, and which adds to the binaural signal a crosstalk cancellation signal based on the position (and/or the rotation angle) of the listener's head. The crosstalk canceller may be implemented in a recursive or feedforward design. Furthermore, the invention may compute the appropriate filter, delay, and gain characteristics directly from the output of the tracking system, or may instead be implemented as a set of filters (or, more typically, filter functions) pre-computed for various listening geometries, the appropriate filters being activated during operation as the listener moves; the system is also capable of interpolating among the pre-computed filters to more precisely accommodate user movements (not all of which will result in geometries coinciding with those upon which the pre-computed filters are based).

In a second aspect, the invention addresses the high-frequency components not generally affected by the crosstalk canceller. Moreover, since the wavelengths involved are small, cancellation of these frequencies cannot be accomplished using a nonindividualized head model; attempts to cancel high-frequency crosstalk can actually sound worse than simply passing the high frequencies unmodified. Indeed, even when using an individualized head model, the high-frequency inversion becomes critically sensitive to positional errors because the size of the equalization zone is proportional to the wavelength. In the context of the present invention, however, high frequencies can prove problematic, interfering with dynamic localization by a moving listener. The invention addresses high-frequency interference by considering these frequencies in terms of power (rather than phase). By implementing the compensation in terms of power levels rather than phase adjustments, the invention avoids the shortcomings heretofore encountered in attempting to cancel high-frequency crosstalk.

Moreover, this approach is found to maintain the "power panning" property. As sound is panned to a particular speaker, the listener expects power to emanate from the directionally appropriate speaker; to the extent power output from the other speaker does not diminish accordingly, the power panning property is violated. The invention retains the appropriate power ratio for high frequencies using, for example, a series of shelving filters in order to compensate for variations in the listener's head angle and/or sound panning.

Preferred implementations of the present invention utilize a non-individualized head model based on measurements of a conventional KEMAR dummy head microphone (see, e.g., Gardner et al., *J. Acoust. Soc. Am.* 97(6):3907–3908 (1995)) both for binaural synthesis and transmission-path inversion. It should be appreciated, however, that any suitable head model—including individualized or non-individualized models—may be used to advantage.

BRIEF DESCRIPTION OF THE DRAWINGS

The invention description below refers to the accompanying drawings, of which.

DETAILED DESCRIPTION OF AN ILLUSTRATIVE EMBODIMENT a. Mathematical Framework

Binaural synthesis is accomplished by convolving an input signal with a pair of HRTFs:

$$x = hx \qquad \text{(Eq. 1)}$$

$$x = \begin{bmatrix} x_L \\ x_R \end{bmatrix}, h = \begin{bmatrix} H_L \\ H_R \end{bmatrix}$$

where x is the input signal, x is a column vector of binaural signals, and h is a column vector of synthesis HRTFs. In other words, h introduces the appropriate binaural localizing cues to impart an apparent spatial origin for each reproduced source. Ordinarily, where binaural audio is synthesized rather than reproduced, a location (real or arbitrary) is associated with each source, and binaural synthesis function h introduces the appropriate cues to the signals corresponding to the sources; for example, each source may be recorded as a separate track in a multitrack recording system, and binaural synthesis is accomplished when the signals are mixed. To reproduce rather than synthesize binaural audio, the individual signals must be recorded with spatial cues encoded, in which case the h vector has, in effect, already been applied.

The vector x is a "binaural signal" in that it would be suitable for headphone listening, perhaps with some additional equalization applied. In order to deliver the binaural signal over loudspeakers, it is necessary to cancel the crosstalk. This is accomplished by filtering the signal with a 2×2 matrix T of transfer functions:

$$y = Tx \qquad \text{(Eq. 2)}$$

$$y = \begin{bmatrix} y_L \\ y_R \end{bmatrix}, T = \begin{bmatrix} T_{11} & T_{12} \\ T_{21} & T_{22} \end{bmatrix}$$

where y, the output vector of loudspeaker signals, may be termed a "binaural loudspeaker signal" and the filter T is the crosstalk canceller.

Figure 1:
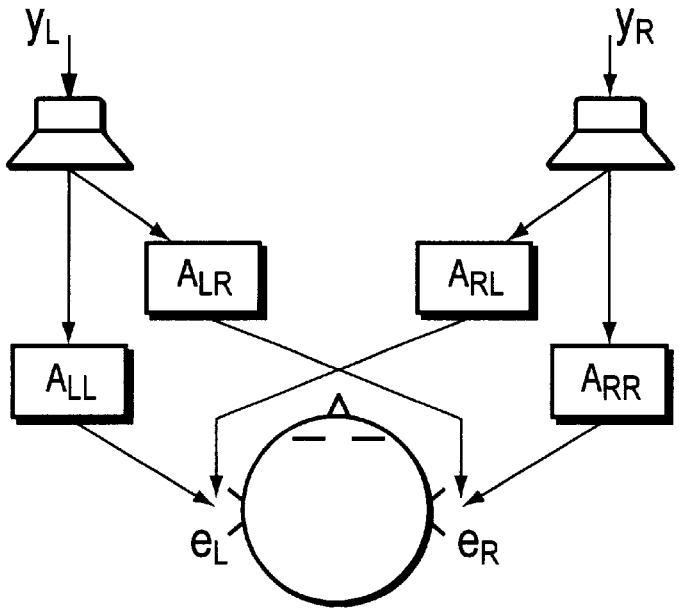
FIG. 1 schematically illustrates a standard loudspeaker listening geometry.

The standard two-channel listening geometry is depicted in FIG. 1. The signals $e_L$ and $e_R$ actually reaching the listener's ears are related to the speaker signals by $$e = Ay \qquad \text{(Eq. 3)}$$

$$e = \begin{bmatrix} e_L \\ e_R \end{bmatrix}, A = \begin{bmatrix} A_{LL} & A_{RL} \\ A_{LR} & A_{RR} \end{bmatrix}$$

where e is a column vector of ear signals, A is the acoustical transfer matrix, and y is a column vector of speaker signals. The ear signals are considered to be measured by an ideal transducer somewhere in the ear canal such that all direction-dependent features of the head response are captured. The functions $A_{xy}$ each represent the transfer function from speaker X $\epsilon\{L, R\}$ to ear Y $\epsilon\{L, R\}$ and include the speaker frequency response, air propagation, and head response. These functions are well-characterized and routinely determined. A can be factored as follows:

$$A = HS \quad \text{(Eq. 4)}$$

$$H = \begin{bmatrix} H_{LL} & H_{RL} \\ H_{LR} & H_{RR} \end{bmatrix}, S = \begin{bmatrix} S_L A_L & 0 \\ 0 & S_R A_R \end{bmatrix}$$

where H is the "head-transfer matrix," a matrix of HRTFs normalized with respect to the free-field response at the center of the head (with no head present). The measurement point of the HRTFs, for example at the entrance of the ear canal—and hence the definition of the ear signals e—is left unspecified for simplicity, this being a routine parameter readily selected by those skilled in the art. S is the "speaker transfer matrix," a diagonal matrix that accounts for the frequency response of the speakers and the air propagation to the listener; again, these are routine, well-characterized parameters. $S_X$ is the frequency response of speaker X and $A_X$ is the transfer function of the air propagation from speaker X to the center of the head (with no head present).

Figure 2:
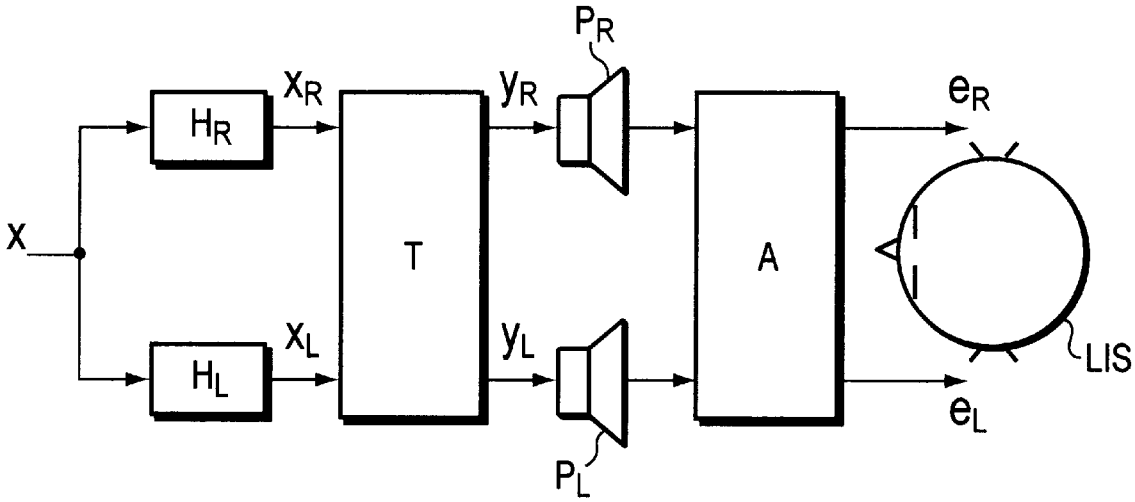
FIG. 2 schematically illustrates a binaural synthesis system implementing crosstalk cancellation.

FIG. 2 illustrates the playback system based on the above methodology. An input signal x is processed by two synthesis HRTFs $H_R$, $H_L$ to create binaural signals $X_R$, $X_L$ (based on predefined spatial positioning values associated with the source of x). These signals are fed through a crosstalk canceller implementing the transfer function T to produce loudspeaker signals $Y_R$, $Y_L$. The loudspeaker signals stimulate operation of the speakers $P_R$, $P_L$ which produce an output that is perceived by the user. The transfer fictional A models the effects of air propagation, relating the output of speakers $P_R$, $P_L$ the sounds $e_R$, $e_L$ actually reaching the listener's ears. In practice, the synthesis HRTFs and the crosstalk-cancellation function T are generally implemented computationally, using conventional digital signal-processing (DSP) equipment. Such equipment can take the form of software (e.g., digital filter designs) running on a general-purpose computer and processing digital (sampled) signals according to algorithms corresponding to the filter function, or specialized DSP equipment having appropriate sampling circuitry and specialized processors configured for rapid execution of signal-processing functions. DSP equipment may include synthesis programs allowing the user to directly create digital signals, analog-to-digital converters for converting analog signals to a digital format, and digital-to-analog converters for converting the DSP output to an analog signal for driving, e.g., loudspeakers. By "general-purpose computer" is meant a conventional processor design including a central-processing unit, computer memory, mass storage device(s), and inputloutput (I/O) capability, all of which allows the computer to store the DSP functions, receive digital and/or analog signals, process the signals, and deliver a digital and/or analog output. Accordingly, block-diagram boxes appearing in the figures herein and denoting signal-processing finctions (other than those, such as A, that occur environmentally) are, unless otherwise specified, intended to represent not only the functions themselves, but also appropriate equipment for their implementation.

Figure 3:
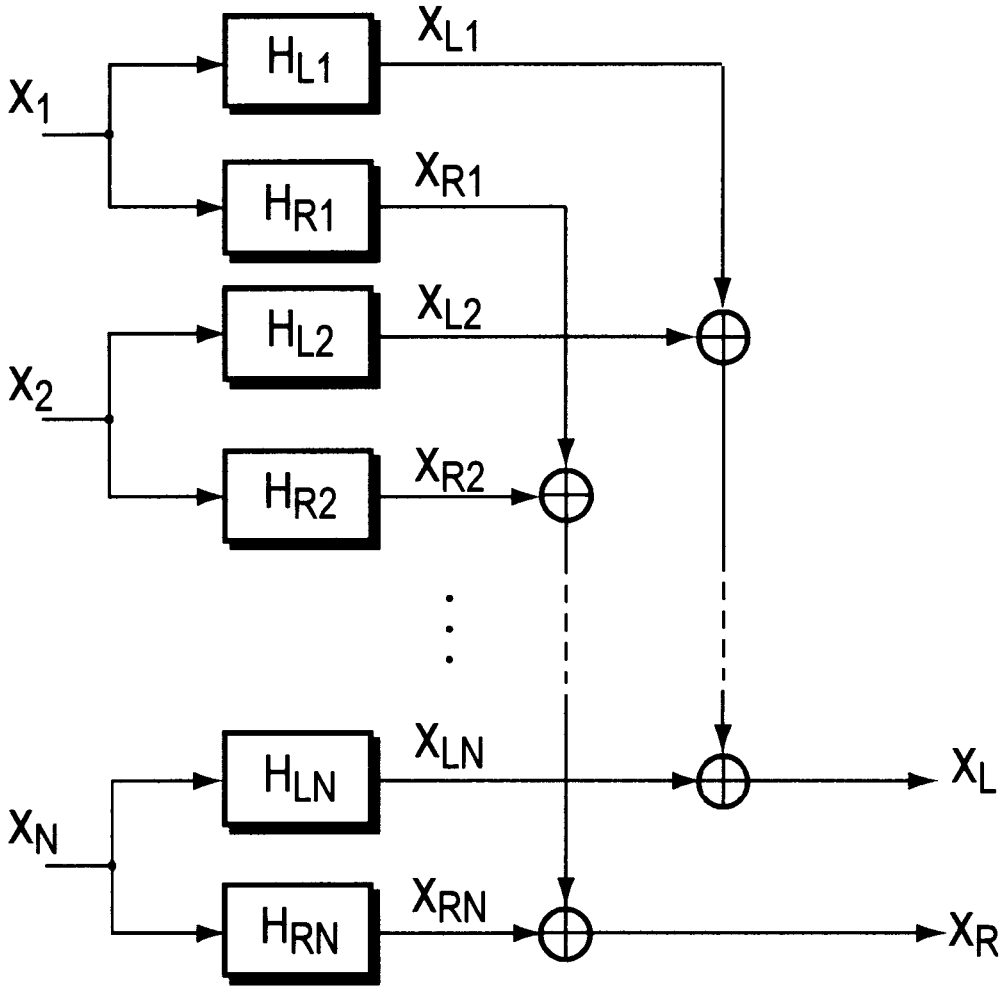
FIG. 3 shows a binaural signal as the sum of multiple input signals rendered at various locations.

FIG. 3 illustrates how the binaural signal x may be the sum of multiple input signals rendered at various locations. Each sound $x_{l^{\cdot}, X2}$. . . $X_N$ is convolved with the appropriate HRTF pair $H_{L1}$, $H_{R1}$; $H_{L2}$, $H_{R2}$. . . $H_{LN}$, $H_{RN}$, and the resulting binaural signals are summed to form the composite binaural signals $X_R$, $X_L$. For simplicity, in the ensuing discussion the binaural-synthesis procedure will be specified for a single source only.

Again with reference to FIG. 2, in order to exactly deliver the binaural signals to the ears, the crosstalk-cancellation filter T is chosen to be the inverse of the acoustical transfer matrix A, such that:

$$T = A^{-1} = S^{-1}H^{-1} \quad \text{(Eq. 5)}$$

This implements the transmission-path inversion. $H^{-1}$ is the inverse head-transfer matrix, and $S^{-1}$ associates an inverse filter with each speaker output:

$$S^{-1} = \begin{bmatrix} 1/(S_L A_L) & 0 \\ 0 & 1/(S_R A_R) \end{bmatrix} \quad \text{(Eq. 6)}$$

The $1/S_x$ terms invert the speaker frequency responses and the $1/A_x$ terms invert the air propagation. In practice, this equalization stage may be omitted if the listener is equidistant from two well-matched, high-quality loudspeakers. When the listener is off-axis, however, it is necessary to delay and attenuate the closer loudspeaker so that the signals from the two loudspeakers arrive simultaneously at the listener with equal amplitude; this signal alignment is accomplished by the $1/A_x$ terms.

In a realtime implementation, it is necessary to cascade the crosstalk-cancellation filter with enough "modeling" delay to create a causal system—that is, a system where the output of each filter derives from a previous input. In an acausal system, which arises only as a mathematical artifact of the modeled filter and cannot actually be realized, the filter output appears to anticipate the input, effectively advancing the input signal in time. In order to correct for this anomaly, the input signal to the acausal filter is delayed so that the filter has effective (i.e., apparent) access to future input samples. Adding a discrete-time modeling delay of m samples to Eq. 5, and representing the resulting signal in the frequency domain using a z-transform:

$$T(z) = z^{-m}S^{-1}(z)H^{-1}(z) \quad \text{(Eq. 7)}$$

The amount of modeling delay needed will depend on the particular implementation. For simplicity, in the ensuing discussion modeling delay and the speaker equalization term $S^{-1}$ are omitted. Thus, while Eq. 5 represents the general solution, for purposes of discussion the crosstalk-cancellation filters are represented herein according to $$T = H^{-1} \quad \text{(Eq. 8)}$$

The inverse head-transfer matrix is given by:

$$H^{-1} = \begin{bmatrix} H_{RR} & -H_{RL} \\ -H_{LR} & H_{LL} \end{bmatrix} \frac{1}{D} \quad \text{(Eq. 9)}$$

$$D = H_{LL}H_{RR} - H_{LR}H_{RL}$$

where D is the determinant of the matrix H. The inverse determinant 1/D is common to all terms and determines the stability of the inverse filter. Because it is a common factor, however, it only affects the overall equalization and does not affect crosstalk cancellation. When the determinant is 0 at any frequency, the head-transfer matrix is singular and the inverse matrix is undefined.

As shown in Moller, *Applied Acoustics* 36:171–218 (1992), Eq. 9 can be rewritten as:

$$H^{-1} = \begin{bmatrix} 1/H_{LL} & 0 \\ 0 & 1/H_{RR} \end{bmatrix} \begin{bmatrix} 1 & -ITF_R \\ -ITF_L & 1 \end{bmatrix} \frac{1}{1 - ITF_L ITF_R} \quad \text{(Eq. 10)}$$

where $$ITF_L = \frac{H_{LR}}{H_{LL}},\ ITF_R = \frac{H_{RL}}{H_{RR}} \quad \text{(Eq. 11)}$$

are the interaural transfer functions (ITFs), described in greater detail below. Crosstalk cancellation is effected by the -ITF terms in the off-diagonal positions of the righthand matrix. These terms estimate the crosstalk and send an out-of-phase cancellation signal into the opposite channel. For instance, the right input signal is convolved with $ITF_R$, which estimates the crosstalk that will reach the left ear, and the result is subtracted from the left output signal. The common term $1/(1-ITF_L ITF_R)$ compensates for higher-order crosstalks—i.e., the fact that each crosstalk cancellation signal itself transits to the opposite ear and must be cancelled. It is a power series in the product of the left and right interaural transfer functions, which explains why both ear signals require the same equalization signal: both ears receive the same high-order crosstalks. Because crosstalk is more significant at low frequences, as explained above, this term is essentially a bass boost. The lefthand diagonal matrix, which may be termed "ipsilateral equalization," associates the ipsilateral inverse filter $1/H_{LL}$ with the left output and $1/H_{RR}$ with the right output. These are essentially high-frequency spectral equalizers and, as is known, are important for perceiving rear sources using frontal loudspeakers. Sounds from the speakers, left unequalized, would naturally encode a frontal directional cue. Thus, in order to apply an arbitrary directional cue (e.g., to simulate a rear source), it is necessary first to invert the frontal cue.

Strictly speaking, the matrix H is invertible if and only if it is non-singular, i.e., if its determinant $D \neq 0$ (see Eq. 9). In practice, it is always possible to limit the magnitude of 1/D in frequency ranges where D is small, and in these frequency ranges the inverse matrix only approximates the true inverse. A stable finite impulse response (FIR) filter can be designed by incorporating suitable modeling delay into the inverse determinant filter.

The form of the inverse matrix given in Eq. 10 suggests a recursive implementation—that is, a topology where the estimated crosstalk is derived from the output of each channel and a negative cancellation signal based thereon is applied to the opposite channel's input signal. Various recursive topologies for implementing crosstalk-cancellation filters are known in the art; see, e.g, U.S. Pat. No. 4,1 18,599.

In particular, if the term $1/(1-ITF_L ITF_R)$ is implemented using a feedback loop, then this will be realizable if the cascade of the two ITFs contains at least one sample of delay. Modeling the ITF as a causal filter cascaded with a delay, the condition for realizability is that the sum of the two interaural time delays (ITDs) be greater than zero:

$$ITD_L + ITD_R > 0$$

Similarly, the feedback loop will be stable if and only if the loop gain is less than 1 for all frequencies:

$$|ITF_L(e^{j\omega})||ITF_R(e^{j\omega})| < 1,\ \forall\omega \quad \text{(Eq. 13)}$$

Considering a spherical head model, these constraints are met when the listener is facing forward, i.e.:

$$-90 < \theta_h < 90 \quad \text{(Eq. 14)}$$

where $\theta_h$ is the head azimuth angle, such that 0 degrees is facing straight ahead.

As explained previously, crosstalk cancellation is advantageously performed only at relatively low frequencies (e.g., ≦6 kHz). The general solution to the crosstalk-cancellation filter function given in Eq. 8 can be bandlimited so that crosstalk cancellation is operative only below a desired cutoff frequency. For example, one can define the transfer function T as follows:

$$T = H_{LP}H^{-1} + H_{HP}\begin{bmatrix} 1 & 0 \\ 0 & 1 \end{bmatrix} \quad \text{(Eq. 15)}$$

where $H_{LP}$ and $H_{HP}$ are lowpass and highpass filters, respectively, with complementary magnitude responses. Accordingly, at low frequencies, T is equal to $H^{-1}$, and at high frequencies T is equal to the identity matrix. This means that crosstalk cancellation and ipsilateral equalization occur at low frequencies, and at high frequencies the binaural signals are passed unchanged to the loudspeakers.

Alternatively, one can define T as:

$$T = \begin{bmatrix} H_{LL} & H_{LP}H_{RL} \\ H_{LP}H_{LR} & H_{RR} \end{bmatrix}^{-1} \quad \text{(Eq. 16)}$$

Here the cross-terms of the head-transfer matrix are lowpass-filtered prior to inversion, as suggested in the '342 patent mentioned above. Applying a lowpass filter to the contralateral terms has the effect of replacing each ITF term in Eq. 10 with a lowpass-filtered ITF. This yields filters that are straightforwardly implemented.

Using the bandlimited form of Eq. 16, at low frequencies T is equal to $H^{-1}$, but now at high frequencies (above the cutoff frequency $f_c$ of the lowpass filter), T continues to implement the ipsilateral equalization:

$$T_{f>f_c} = \begin{bmatrix} 1/H_{LL} & 0 \\ 0 & 1/H_{RR} \end{bmatrix} \quad \text{(Eq. 17)}$$

Using Eq. 16, when sound is panned to the location of a speaker, the response to that speaker will be flat, as desired. Unfortunately, the other speaker will be emitting power at high frequencies, which are unaffected by crosstalk cancellation (that is, the crosstalk-cancellation filter is not implementing the inverse matrix at these frequencies). As detailed below, the invention provides for re-establishing the power panning property at high frequencies.

b. Crosstalk Cancellation for a Moving Listener

As suggested above, the ITF represents the relationship between ear signals (i.e., sound pressures) reaching the two ears from a given source location, and is represented generally by the ratio:

$$ITF = \frac{H_c}{H_i} \quad \text{(Eq. 18)}$$

where $H_c$ is the contralateral response and Hi is the ipsilateral response. The ITF has a magnitude component reflecting increasing attenuation due to head diffraction as frequency increases, and a phase component reflecting the fact that the signal from the ipsilateral speaker reaches the ipsilateral ear before it reaches the contralateral ear (i.e., the interaural time delay, or ITD). Using a KEMAR ITF at 30 degrees incidence, it has been observed that at frequencies below 6 kHz, the frequency component of the ITF behaves like a lowpass filter with a gentle rolloff, but at higher frequencies the ITF magnitude has large peaks corresponding to notches in the ipsilateral response.

Because the sound wavefront reaches the ipsilateral ear first, it is tempting to think that the ITF has a causal time representation. In fact, the inverse ipsilateral response will be infinite and two-sided because of non-minimum-phase zeros in the ipsilateral response. The ITF therefore will also have infinite and two-sided time support. Nevertheless, it is possible to accurately approximate the ITF at low frequencies using causal (and stable) filters. Causal implementations of ITFs are needed to implement realizable, realtime filters that can model head diffraction.

It is known that any rational system function—that is, a function describing a filter that can actually be built—can be decomposed into a minimum-phase system cascaded with an allpass-phase system, which can be represented mathematically as:

$$H(z)=\mathrm{minp}(H(z))\mathrm{allp}(H(z)) \qquad \text{(Eq. 19)}$$

According to this formulation, the ITF can be seen as the ratio of the minimum-phase parts of the contralateral and ipsilateral responses cascaded with an all-pass system whose phase response is the difference of the excess (allpass) phases of the ipsilateral and contralateral responses at the two ears (see Jot et al., "Digital Signal Processing Issues in the Context of Binaural and Transaural Stereophony," *Proc. Audio Eng. Soc. Conv.* (1995)):

$$ITF(e^{j\omega}) = \frac{\mathrm{minp}(H_c(e^{j\omega}))}{\mathrm{minp}(H_i(e^{j\omega}))} e^{j(\angle allp(H_c(e^{j\omega}))-\angle allp(H_i(e^{j\omega})))} \qquad \text{(Eq. 20)}$$

It has been shown that for all incidence angles, the excess phase difference in Eq. 20 is approximately linear with frequency at low frequencies. Consequently, the ITF can be modeled as a frequency-independent delay cascaded with the minimum-phase part of the true ITF:

$$ITF(e^{j\omega}) \cong \frac{\mathrm{minp}(H_c(e^{j\omega}))}{\mathrm{minp}(H_i(e^{j\omega}))} e^{j\omega ITD/T} \qquad \text{(Eq. 21)}$$

where ITD is the frequency-independent interaural time delay, and T is the sampling period.

The invention requires lowpass-filtered ITFs. Because these are to be used to predict and cancel acoustic crosstalk, accurate phase response is critical. High-order zero-phase lowpass filters are unsuitable for this purpose because the resulting ITFs would not be causal. In accordance with the invention, m samples of modeling delay are transferred from the ITD in order to facilitate design of a lowpass filter that is approximately (or exactly) linear phase with a phase delay of m samples. The resulting lowpassfiltered ITF may be generalized as follows:

$$H_{LPF}(e^{j\omega})\mathrm{ITF}(e^{j\omega}) \approx L(e^{j\omega})e^{-j\omega(ITD/T-m)} \qquad \text{(Eq. 22)}$$

such that $$l[n]=0 \text{ for } n<0$$

$$\angle H_{LPF}(e^{j\omega}) \approx -m\omega$$

where $L(e^{j\omega})$ is a causal filter—causality is enforced by the condition $l[n]=0$ for $n<0$—that describes head diffraction within some time shift, and m is the modeling delay of $H_{LPF}(e^{j\omega})$ taken from the ITD. The closest approximation is obtained when all the available ITD is used for modeling delay. However, it is also possible to utilize a parameterized implementation that cascades a filter L(z) with a variable delay to simulate an azimuth-dependent ITF. In this case, the range of simulated azimuths is increased if m is minimized.

There are two approaches to obtaining the filter L(z), differing in the method by which the ITF is calculated. One technique is based on the ITF model of Eq. 21, and entails (a) separating the HRTFs into minimum-phase and excess-phase parts, (b) estimating the ITD by linear regression on the interaural excess phase, (c) computing the minimum-phase ITF, and (d) delaying this by the estimated ITD. The other technique is to calculate the ITF by convolving the contralateral response with the inverse ipsilateral response. The inverse ipsilateral response can be obtained by computing its discrete Fourier transform (DFT), inverting the spectrum, and computing the inverse DFT. Using either method of computing the ITF, the filter L(z) can then be obtained by lowpass filtering the ITF and extracting l[n] from the time response starting at sample index floor(ITD/T−m).

Figure 4:
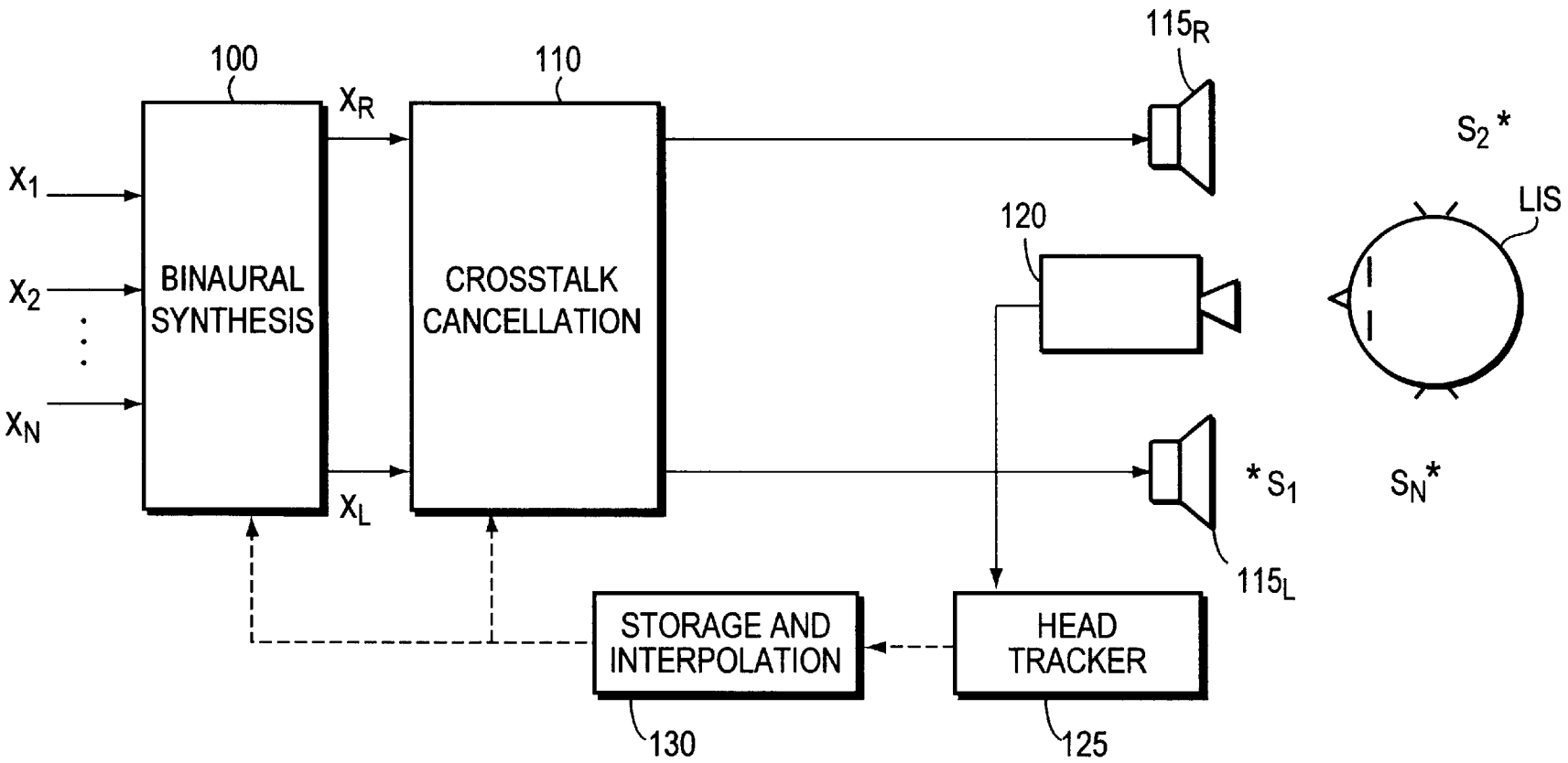
FIG. 4 is a schematic representation of a binaural synthesis system in accordance with the invention.

The basic topology of a system implementing the invention is shown in FIG. 4. A series of sounds $x_1 \ldots X_N$, each associated with a spatial location, are provided to a binaural synthesis module. In accordance with Eq. 1, module 100 generates a binaural signal vector x with the components $X_L$ $X_R$. These are fed to a crosstalk-cancellation unit 110, which generates crosstalk-cancellation signals in the manner described above and combines the cancellation signals with $X_L$ and $X_R$. The final signals are fed to a pair of loudspeakers $\mathbf{115}_R$, $\mathbf{115}_L$, which emit sounds perceived by the listener LIS. The system also includes a video camera 117 and a head-tracking unit 125. Camera 117 generates electronic picture signals that are interpreted in realtime by tracking unit 125, which derives therefrom both the position of listener LIS relative to speakers $\mathbf{115}_R$, $\mathbf{115}_L$ and the rotation angle of the listener's head relative to speakers $\mathbf{115}_R$, $\mathbf{115}_L$. Equipment for analyzing video signals in this manner is well-characterized in the art; see, e.g., Oliver et al., "LAFTER: Lips and Face Real Time Tracker," *Proc. IEEE Int. Conf on Computer Vision and Pattern Recognition*(1997).

The output of tracking system 125 is utilized by modules 100, 110 to generate the binaural signals and crosstalk-cancellation signals, respectively. Preferably, however, tracking-system output is not fed directly to modules 100, 110, but is instead provided to a storage and interpolation unit 130, which, based on head position and rotation, selects appropriate values for the filter functions implemented by modules 100, 110. As a result of binaural synthesis and crosstalk cancellation, the sounds $s_1 \ldots S_N$ emitted by speakers $\mathbf{115}_R$, $\mathbf{115}_L$, and corresponding to the input signals $x_1 \ldots X_N$, appear to the listener LIS to emanate from the spatial locations associated with the input signals.

Figure 5:
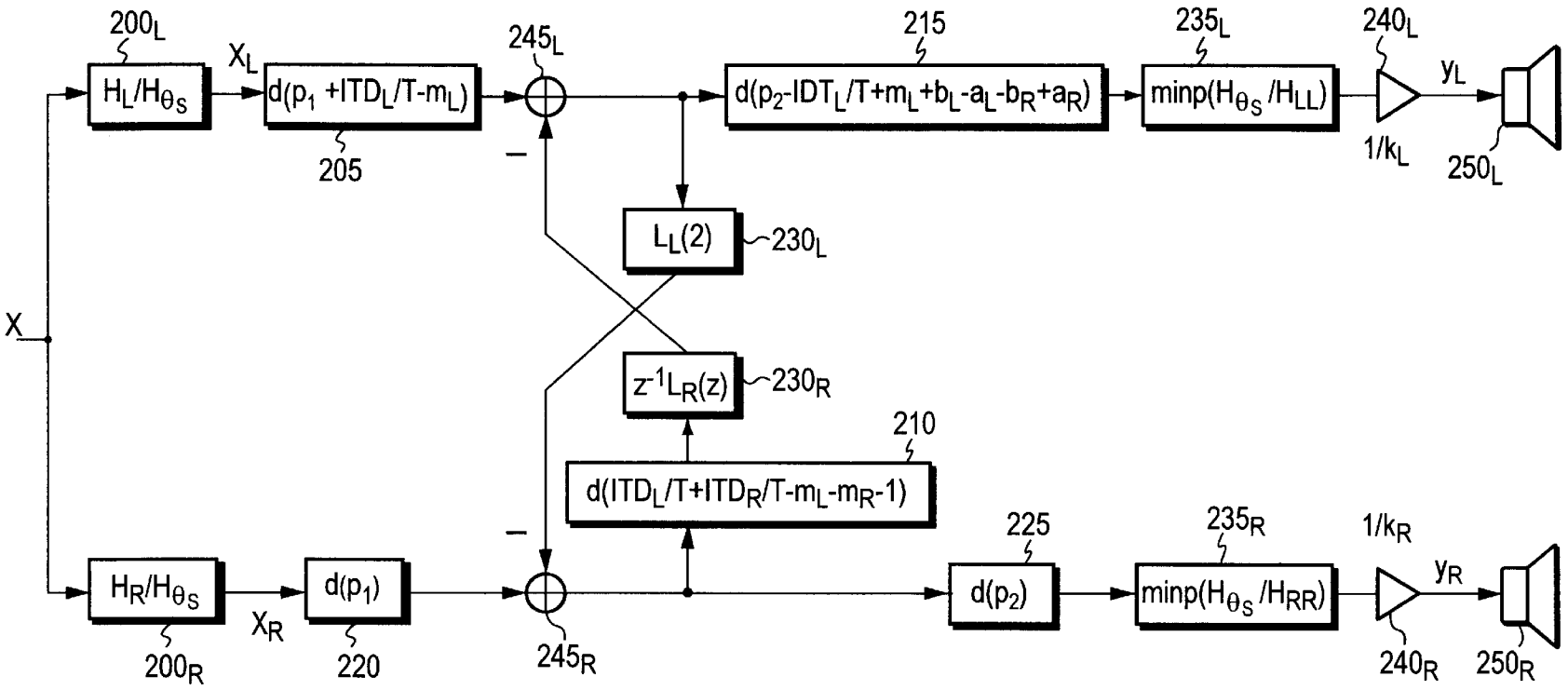
FIG. 5 is a more detailed schematic of an implementation of the binaural synthesis module and crosstalk canceller shown in FIG. 4.

FIG. 5 illustrates a recursive, bandlimited implementation of binaural synthesis module 100 and crosstalk canceller 110, which together compensate for head position and angle. The illustrated filter topology includes means for receiving an input signal x; a pair of right-channel and left-channel HRTF filters $\mathbf{200}_L$, $\mathbf{200}_R$, respectively; three variable delay lines 205, 210, 215 that dynamically change in response to head position and rotation angle data reported by tracking unit 125; two fixed delay lines 220, 225 that enforce the condition of causality, ensuring that the variable delays are always non-negative; a pair of right-channel and left-channel "head-shadowing" filters $\mathbf{230}_L$, $\mathbf{230}_R$, respectively, that model head diffraction and are also responsive to tracking unit 125; a pair of minimum-phase ipsilateral equalization filters $\mathbf{235}_L$, $\mathbf{235}_R$; and a pair of variable gains (amplifiers) $240_L$, $240_R$, which compensate for attenuation due to air propagation over different distances to the different ears. The recursive structure is implemented by a pair of negative adders $245_L$, $245_R$ which, respectively, negatively mix the output of head-shadowing filter $230_R$ with the left-channel signal emanating from variable delay 205, and the output of head-shadowing filter $230_L$ with the right-channel signal emanating from fixed delay 220. Crosstalk cancellation is effected by head-shadowing filters $230_L$, $230_R$; variable delays 205, 210, 215; minimum-phase equalization filters $235_L$, $235_R$; and variable gains $240_L$ $240_R$. The result is a pair of speaker signals $Y_L$, $Y_R$ that drive respective loudspeakers $250_L$, $250_R$.

Figure 6:
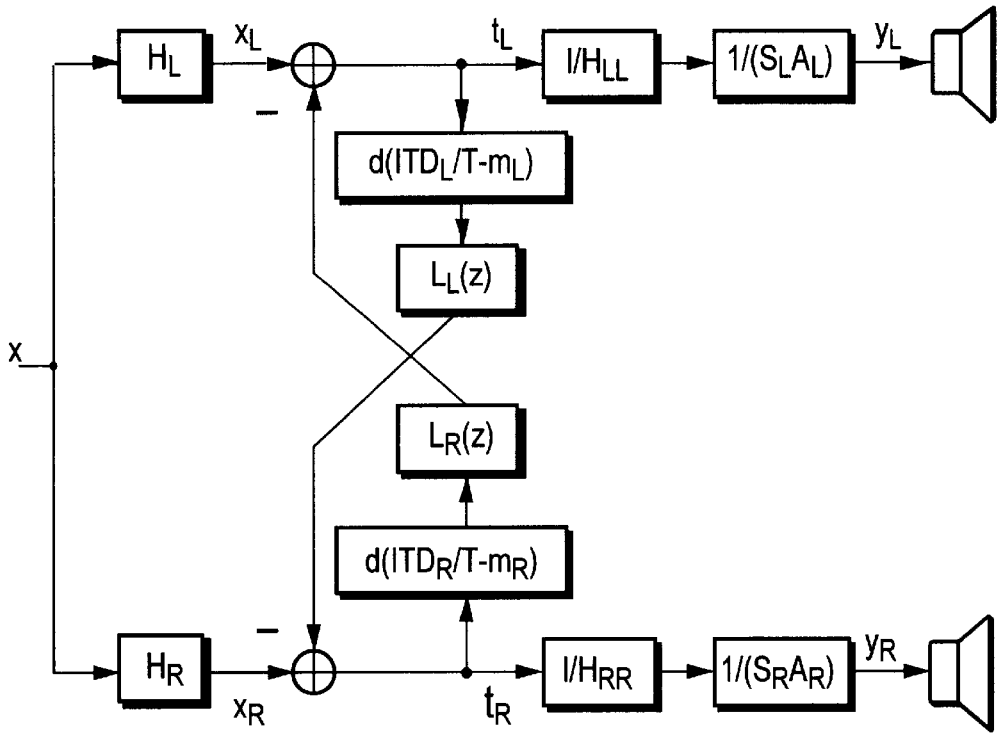
FIGS. 6 and 7 are simplifications of the topology illustrated in FIG. 5.
Figure 7:
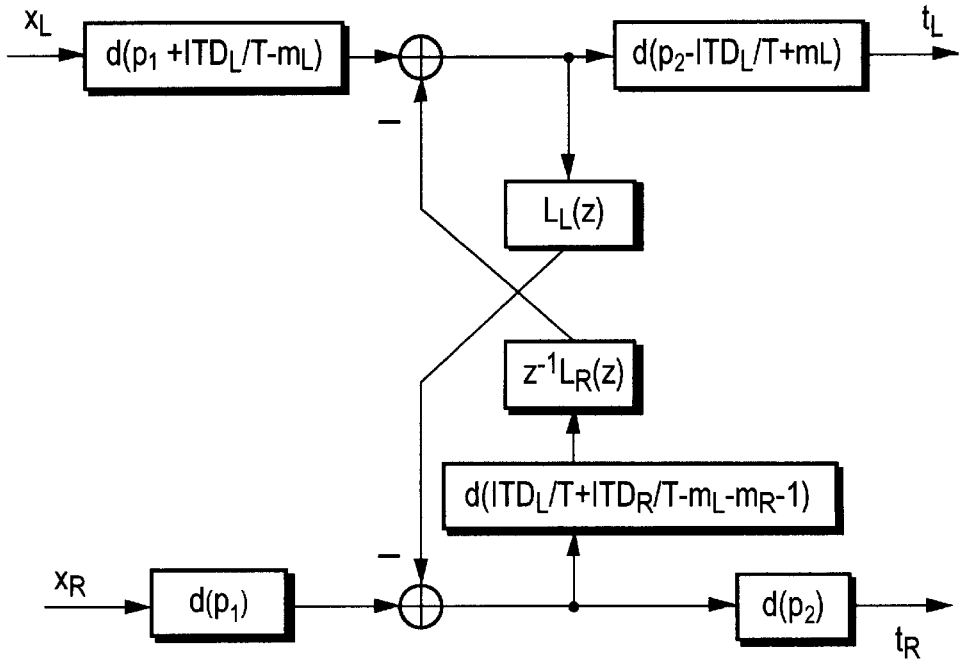

Operation of the implementation shown in FIG. 5 may be understood with reference to FIGS. 6 and 7, which illustrate simplifications of the approach taken. For simplicity of discussion, the various hypothetical filters of FIGS. 6 and 7 are treated as functions (and are not labeled as components actually implementing the functions).

In FIG. 6, the left and right components of the input signal x are processed by a pair of HRTFs $H_L$, $H_R$, respectively. The functions $L_L(z)$ and $L_R(Z)$ correspond to the filter functions L(z) described earlier. As these model the interaural transfer functions, each effectively estimates the crosstalk that will reach the contralateral ear. Accordingly, the crosstalk is cancelled by feeding the negative of this estimated signal to the opposite channel. By feeding back to the opposite channel's input rather than its output, higher-order crosstalks are automatically cancelled as well. The resulting additive signals $t_L$, $t_R$ must then be equalized with the inverse ipsilateral response ($1/H_{LL}$, $1/H_{RR}$). The delays $ITD_L/T$, $ITD_R/T$ compensate. for the interaural time delays to the contralateral ears, while the delays $m_L$, $m_R$ representing modeling delays inherent in the $L_L(z)$ and $L_R(Z)$ functions. The functions $1/(S_LA_L)$, $1/(S_RA_L)$ implement Eq. 6, compensating for speaker frequency responses and air propagation by delaying and attenuating the closer loudspeaker.

The structure of FIG. 6 is realizable only when both feedback delays (i.e., $d(ITD_L/T-m_L)$, $d(ITD_R/T-m_R)$ are greater than 1. To allow one of the ITDs to become negative, the total loop delay is coalesced into a single delay. This is shown in FIG. 7. The delays $d(p_1)$, $d(p_2)$ implement integer or fractional delays of p samples, with $P_1$ and $P_2$ chosen to be large enough so that all variable delays are always non-negative. The function $z^{-1}L_R(z)$ represents $L_R(Z)$ cascaded with a single sample delay, the latter necessary to ensure that the feedback loop is realizable (since the loop delay $d(ITD_L/T+ITD_R/T-m_L-m_R-1)$ is not prohibited from going to zero). The realizability constraint is then:

$$\frac{ITD_L}{T}+\frac{ITD_R}{T}-m_L-m_R-1\geq 0 \qquad \text{(Eq. 23)}$$

This constraint accounts for the single sample delay remaining in the loop and the modeling delays inherent in the lowpass head-shadowing filters $L_L(z)$, $L_R(Z)$.

With renewed reference to FIG. 4, equalization of the crosstalk-cancelled output signals $t_L$, $t_R$ is effected by filters $235_L$, $235_R$ and gains $240_L$, $240_R$. It should be stressed that the ipsilateral equalization filters 235 not only provide high-frequency spectral equalization, but also compensate for the asymmetric path lengths to the ears when the head is rotated. To convert the functions implemented by ipsilateral filters 235 to ratios, thereby facilitating separation of the asymmetric path-length delays according to Eq. 21, it is possible to use free-field equalized synthesis HRTFs; the ipsilateral equalization filter functions then become referenced to the free-field direction (i.e., an ideal incident angle to a speaker, usually 30° from each ear for a two-speaker system). It is most convenient to reference the synthesis HRTFs with respect to the loudspeaker direction $\theta_s$.

Using this approach, the expression $H_x/H_{\theta_s}$ represents the synthesis filter in channel $X\in\{L, R\}$ and the corresponding ipsilateral equalization filter becomes $H_{\theta_s}/H_{xx}$, where $H_{\theta_s}$ is the HRTF for the speaker incidence angle $\theta_s$. Thus, the ipsilateral equalization filter function will be flat when the head is not rotated. The function $H_{\theta_s}$ is a constant parameter of the system, derived once and stored as a permanent function of frequency. Applying the model of Eq. 21, $$\frac{H_{\theta_s}(e^{j\omega})}{H_{XX}(e^{j\omega})}\cong \min p\left(\frac{H_{\theta_s}(e^{j\omega})}{H_{XX}(e^{j\omega})}\right)e^{-j\omega b_X} \qquad \text{(Eq. 24)}$$

where $b_x$ is the delay in samples for ear $X\in\{L, R\}$ relative to the unrotated head position.

In practice, the speaker inverse filters $1/S_X$ may be ignored. On the other hand, the air-propagation inverse filters $1/A_x$ are very important, because they compensate for unequal path lengths from the speakers to the center of the head. This effect may be modeled accurately as:

$$A_x(e^{j\omega})=k_xe^{-j\omega_x} \qquad \text{(Eq. 25)}$$

The combined ipsilateral and air-propagation inverse filter for channel X-i.e., the function implemented by filters $235_L$, $235_R$—is then:

$$\frac{H_{\theta_s}(e^{j\omega})}{H_{XX}(e^{j\omega})}\cdot\frac{1}{A_X(e^{j\omega})}\cong\frac{1}{k_X}\min p\left(\frac{H_{\theta_s}(e^{j\omega})}{H_{XX}(e^{j\omega})}\right)e^{-j\omega(b_X-a_X)} \qquad \text{(Eq. 26)}$$

A final simplification is to combine all of the variable delay into the left channel (i.e., into delay 215), which is accomplished by associating a variable delay of $a_L-b_L$ with both channels. As a result, the head motions that change the difference in path lengths from the speakers to the ears will induce a slight but substantially unnoticeable pitch shift in both output channels.

The filter functions $H_x$, $H_{xx}$, $ITD_x$, and $L_x(z)$, as well as the delays $a_x$ and $b_x$ and the gains $1/k_x$, explicitly account for head angle and position. Consequently, their values must be updated as the listener's head moves. Rather than attempt to solve the complicated mathematics in realtime during operation, it is preferred to pre-compute a relatively large table of delay and gain parameters and filter coefficients, each set being associated with a particular listener geometry. The table may be stored as a database by storage and interpolation unit 130 (e.g., permanently in a mass-storage device, but at least in part in fast-access volatile computer memory during operation). As tracking system 125 detects shifts the listener's head position and rotation angle relative to the speakers, it accesses the corresponding functions and parameters, and provides these to crosstalk canceller 110—in particular, to the filter elements implementing the functions $H_x$, $H_{xx}$, $ITD_x$, and $L_x(z)$, $a_x$, $b^x$, and $1/k_x$. For listener geometries not precisely matching a stored entry, unit 130 interpolates between the closest entries.

Figure 8:
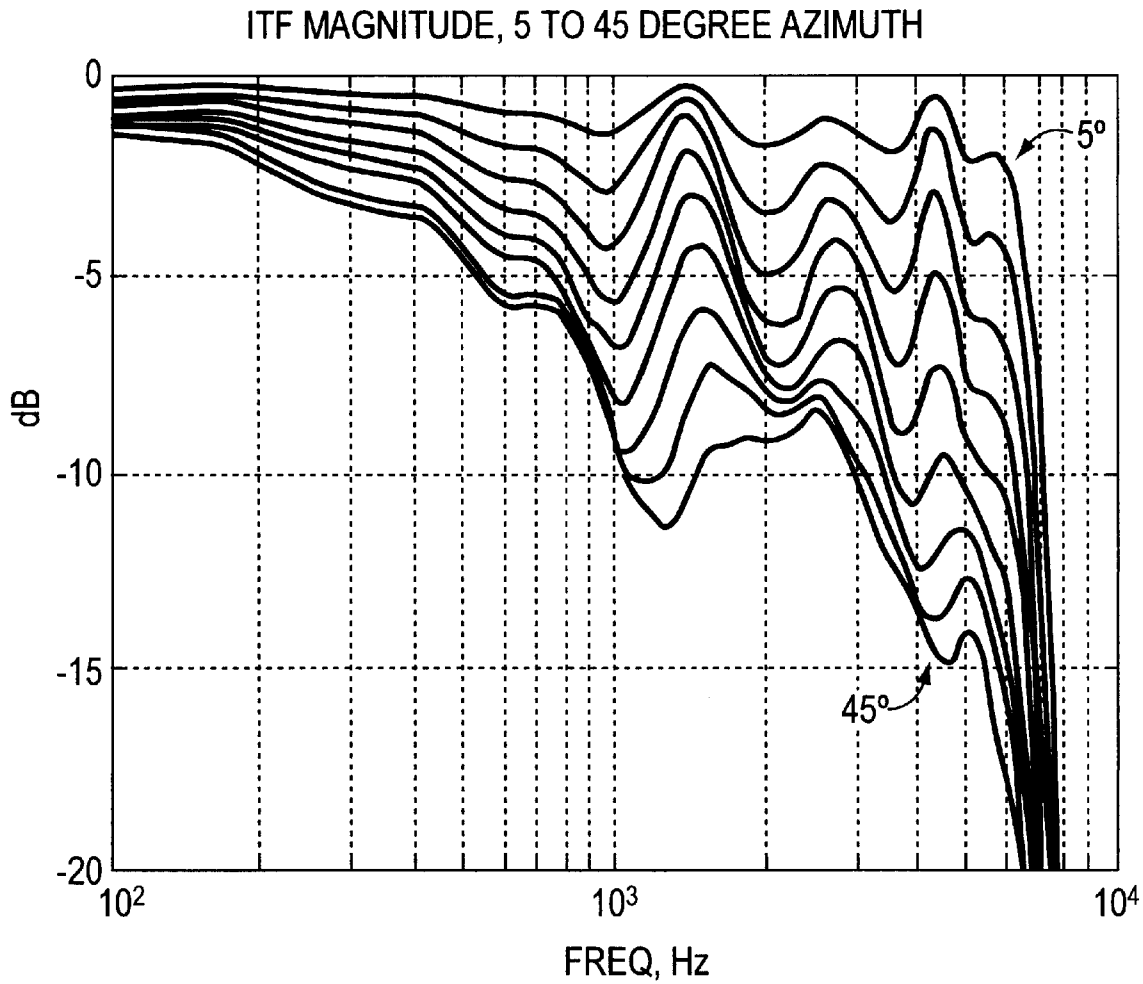
FIGS. 8–10 are plots of various parameters of the invention for varying head-to-speaker angles.

Filters $230_L$, $230_R$ may be implemented using low-order infinite impulse response (IIR) filters, with values for different listener geometries computed in accordance with Eqs. 21 and 22. HRTFs are well characterized, and $H_x$ and $H_{xx}$ can therefore be computed, derived empirically, or merely selected from published HRTFs to match various listener geometries. In FIG. 8, the L(z) filter function is shown for azimuth angles ranging from 5° to 45°.

Figure 9:
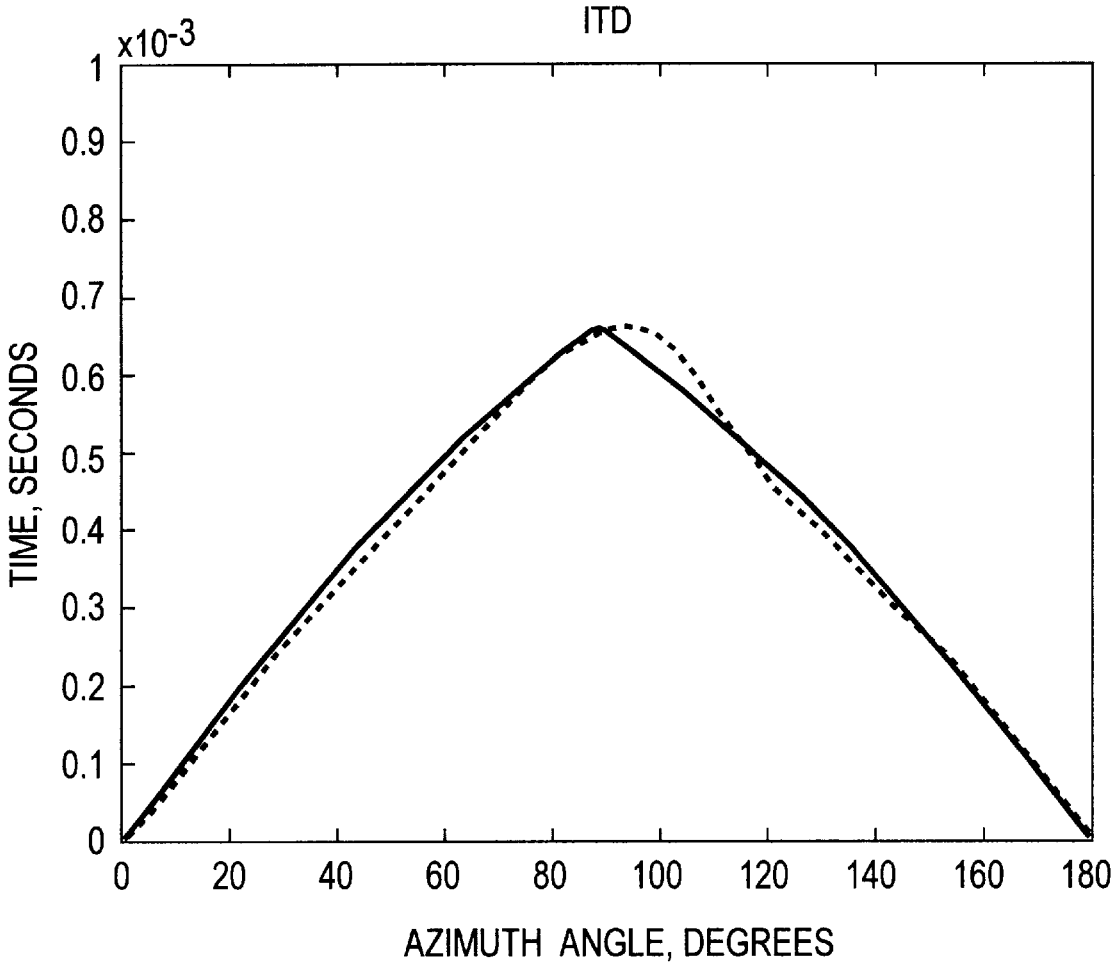

Delay lines 205, 210, 215 may be implemented using low-order FIR interpolators, with the various components computed for different listener geometries as follows. The parameter $ITD_x$ is a function of the head angle with respect to speaker X, representing the different arrival times of signals reaching the ipsilateral and contralateral ears. $ITD_x$ can be calculated from a spherical head model; the result is a simple trigonometric function:

$$ITD_x = D/2c(\theta_x + \sin\theta_x) \quad \text{(Eq. 27)}$$

where D=17.5 cm is the spherical head diameter, c=344 m/sec is the speed of sound, and $\theta_x$ is the incidence angle of speaker X with respect to the listener's head, such that ipsilateral incidence results in positive angles and hence positive ITDs. Alternatively, the ITD can be calculated from a set of precomputed ITFs by separating the ITFs into minimum-phase and allpass-phase parts, and computing a linear regression on the allpass-phase part (the interaural excess phase). FIG. 9 shows both methods of computing the ITD for azimuths from 0 to 180°: the solid line represents the geometric model of Eq. 27, while the dashed line is the result of performing linear regression on the interaural excess phase.

The parameter $b_x$ is a function of head angle, the constant parameter $\theta_s$ (the absolute angle of the speakers with respect to the listener when in the ideal listening location), and the constant parameter $f_s$ (the sampling rate). The parameter $b_x$ represents the delay (in samples) of sound from speaker X reaching the ipsilateral ear, relative to the delay when the head is in the ideal (unrotated) listening location. Like $ITD_x$, $b^x$ may be calculated from a spherical head model; the result is a trigonometric function:

$$b_R(\theta_H) = -\frac{Df_s}{2c}(s(\theta_H - \theta_S) + s(\theta_S)) \quad \text{(Eq. 28)}$$

where $\theta_H$ is the rotation angle of the head, such that $\theta_H=0$ when the listener's head is facing forward, and the function $s(\theta)$ is defined as:

$$s(\theta) = \begin{cases} \sin\theta, & \theta < 0 \\ \theta, & \theta > 0 \end{cases} \quad \text{(Eq. 29)}$$

Figure 10:
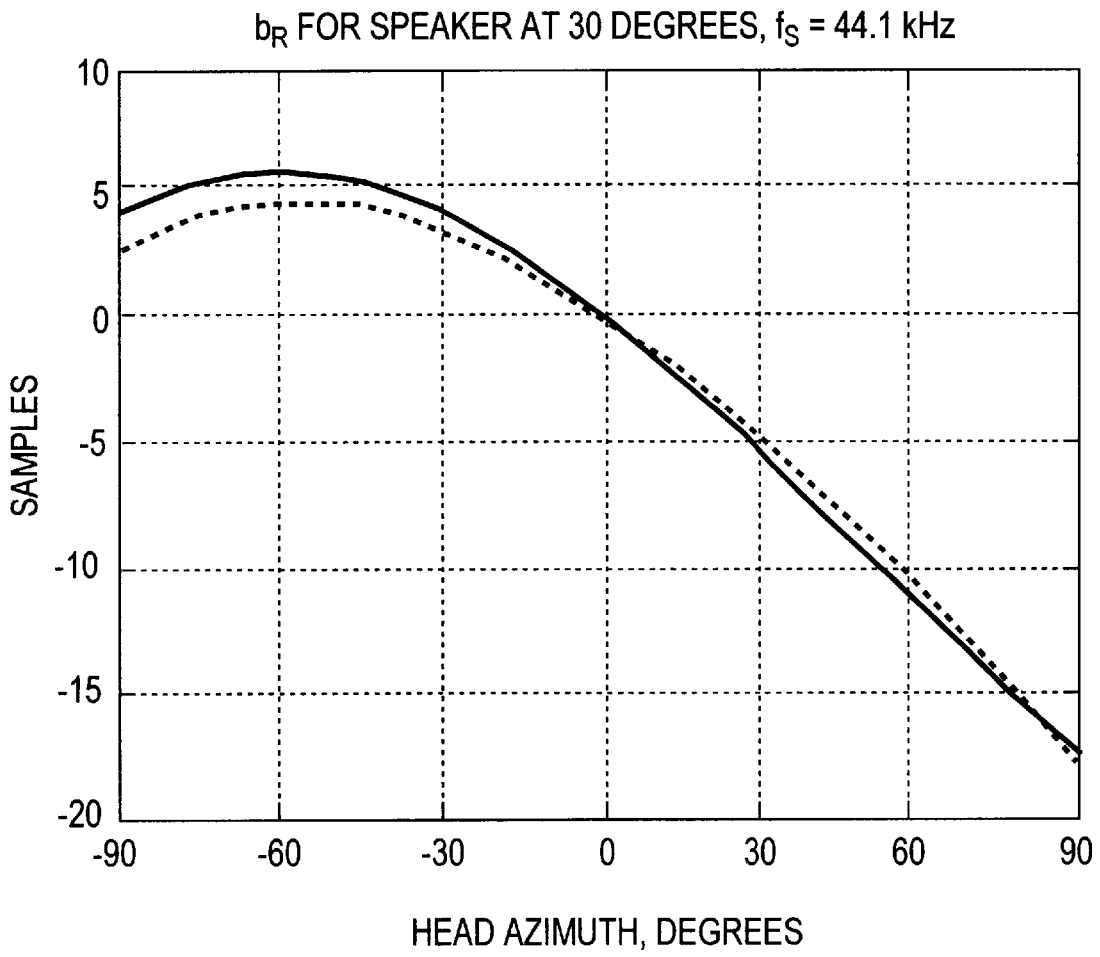

Finally, $b_L(\theta)$ is defined as $b_R(-\theta)$. An alternative to using the spherical head model is to compute the $b^x$ parameter by performing linear regression on the excess-phase part of the ratio of the HRTFs $H_{\theta_x}$ and $H_{xx}$. This is analogous to the above-described technique for determine the ITD from a ratio of two HRTFs. FIG. 10 shows the results of using both methods to compute $b_R$ for head azimuths from −90° to +90°, with $\theta_s=30, f_s=44100$: the solid line represents the geometric model of Eq. 28, and the dashed line results from performing linear regression on the excess-phase part of the ratio of the appropriate HRTFs.

The parameters $a_x$ and $k_x$ are functions of the distances $d_L$ and $d_R$ between the center of the head and the left and right speakers, respectively. These distances are provided along with the head-rotation angle by tracking means 125 (see FIG. 4). In accordance with Eq. 25, $a_x$ represents the air-propagation delay in samples between speaker X and the center of the head, and $k_x$ is the corresponding attenuation in sound pressure due to the air propagation. Without loss of generality, these parameters may be normalized with respect to the ideal listening location such that $a_x=0$ and $k_x=1$ when the listener is ideally situated. The equations for $a_x$ and $k_x$ are then:

$$a_X = \frac{f_s(d_X - d)}{c} \quad \text{(Eq. 30)}$$

$$k_X = \frac{d}{d_X}$$

where $d_x$ is the distance from the center of the head to speaker X (expressed in meters), and d is the distance from the center of the head to the speakers when the listener is ideally situated (also expressed in meters).

Figure 11:
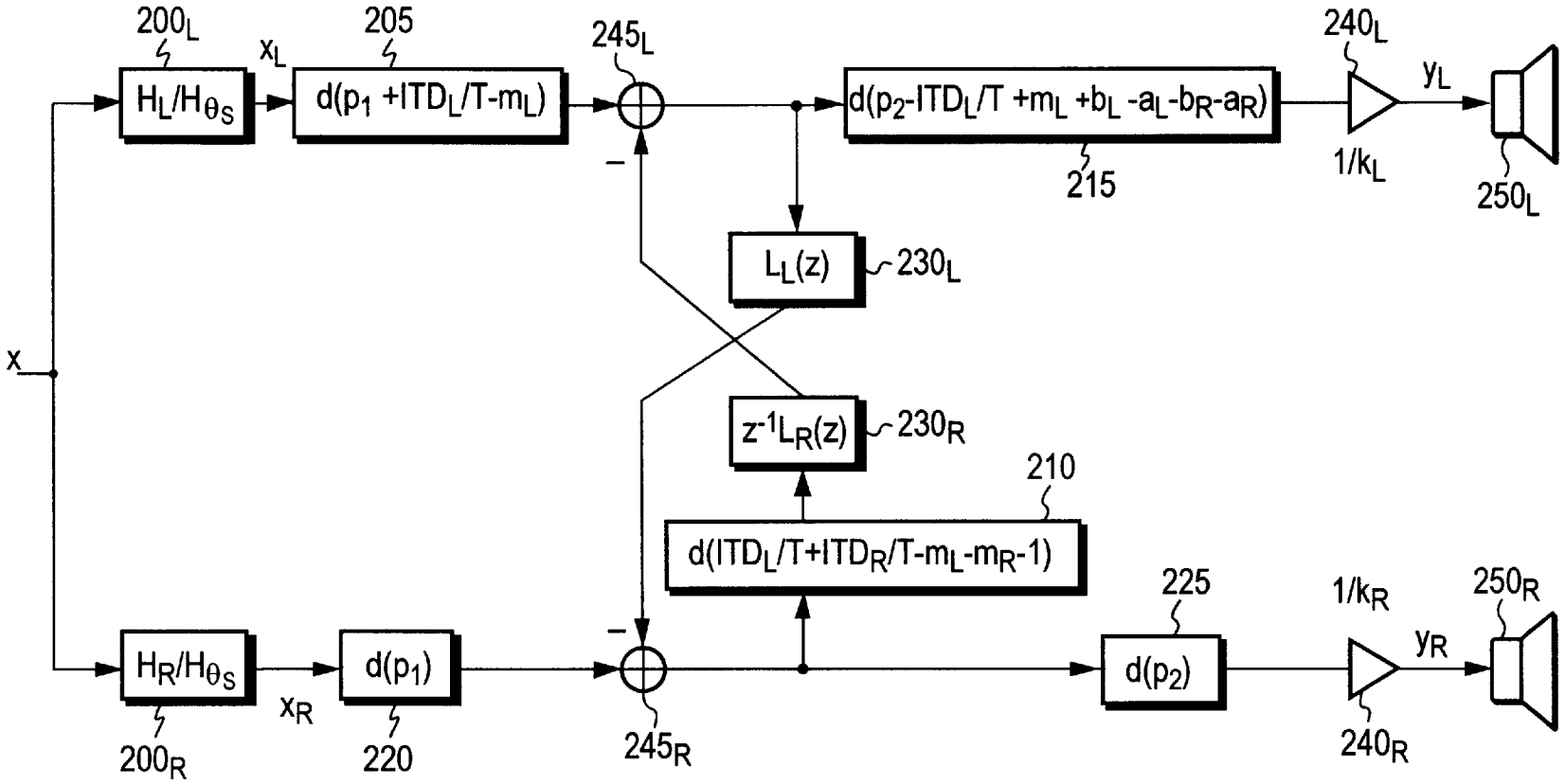
FIG. 11 is an alternative implementation of the topology illustrated in FIG. 5.
Figure 12:
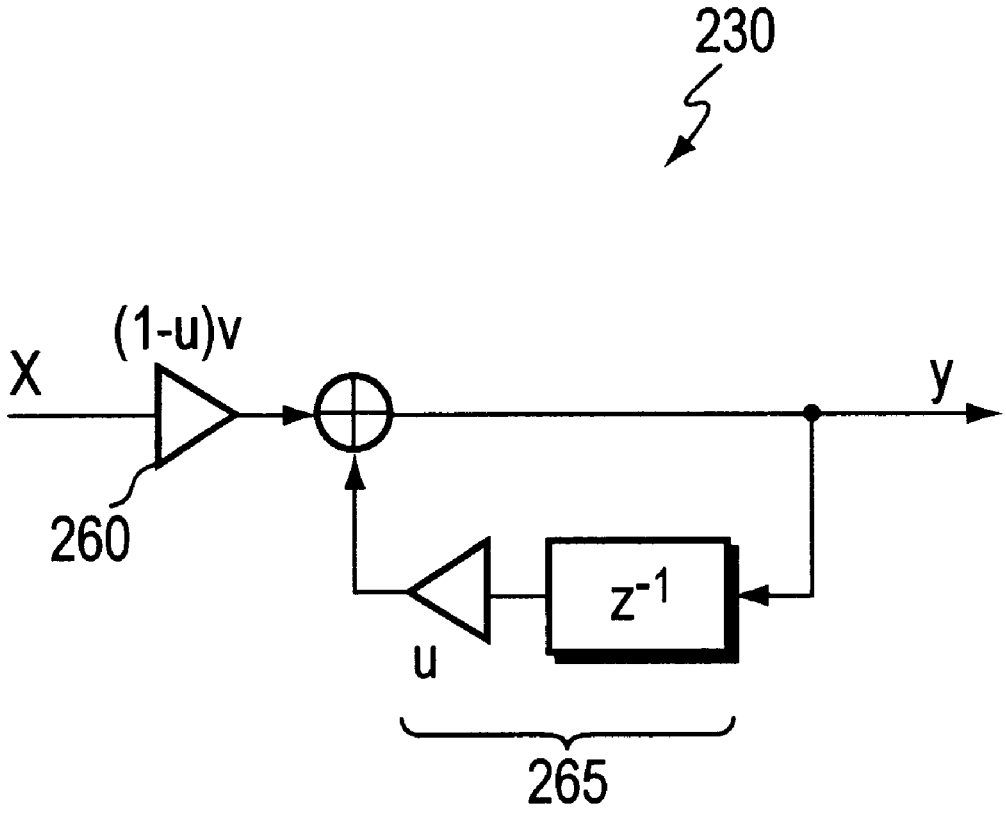
FIG. 12 illustrates a one-pole, DC-normalized, lowpass filter for use in conjunction with the implementation of FIG. 11.

The implementation shown in FIG. 5 can be simplified by eliminating the ipsilateral equalization filters $\mathbf{235}_L$, $\mathbf{235}_R$ as illustrated in FIG. 11. This approach uses efficient implementations for the head-shadowing filters $\mathbf{230}_L$, $\mathbf{230}_R$ and for the variable delay lines 205, 210, 215. Preferably, each head-shadowing filter $\mathbf{230}_L$, $\mathbf{230}_R$ is implemented as shown in FIG. 12, using a one-pole, DC-normalized, lowpass filter 260 cascaded with an attenuating multiplier 265. The frequency cutoff of lowpass filter 260, specified by the parameter u (and representing a simple function of $f_{cf}$ and $f_s$), is preferably set between 1 and 2 kHz. The parameter v specifies the DC gain of the circuit, and is preferably between 1 and 3 db of attenuation. Using this implementation of head-shadowing filter 230, the modeling delays $m_L$, $m_R$ are both zero, and the $ITD_L$, $ITD_R$ parameters calculated as described above.

Figure 13:
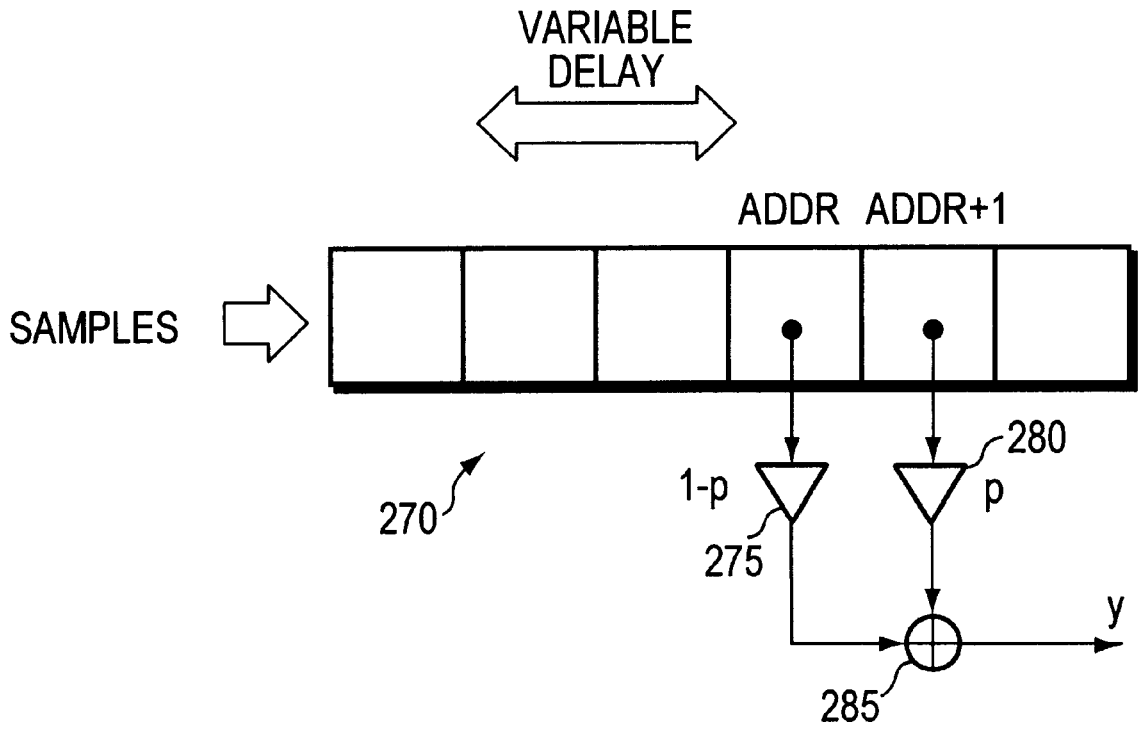
FIG. 13 illustrates linearly interpolated delay lines for use in conjunction with the implementation of FIG. 11.

Variable delay lines 205, 210, 215 can be implemented using linearly interpolated delay lines, which are well known in the art. A computer-based device is shown in FIG. 13. Input samples enter the delay line 270 on the left and are shifted one element to the right each sampling period. In practice, this is accomplished by moving the read and write pointers that access the delay elements in computer memory. A delay of D samples, where D has both integer and fractional parts, is created by computing the weighted sum of two adjacent samples read from locations addr and addr+1 using a pair of variable gains (amplifiers) 275, 280 and an adder 285. The parameter addr is obtained from the integer part of D, and the weighting gain 0 <p<1 is obtained from the fractional part of D.

Figure 14:
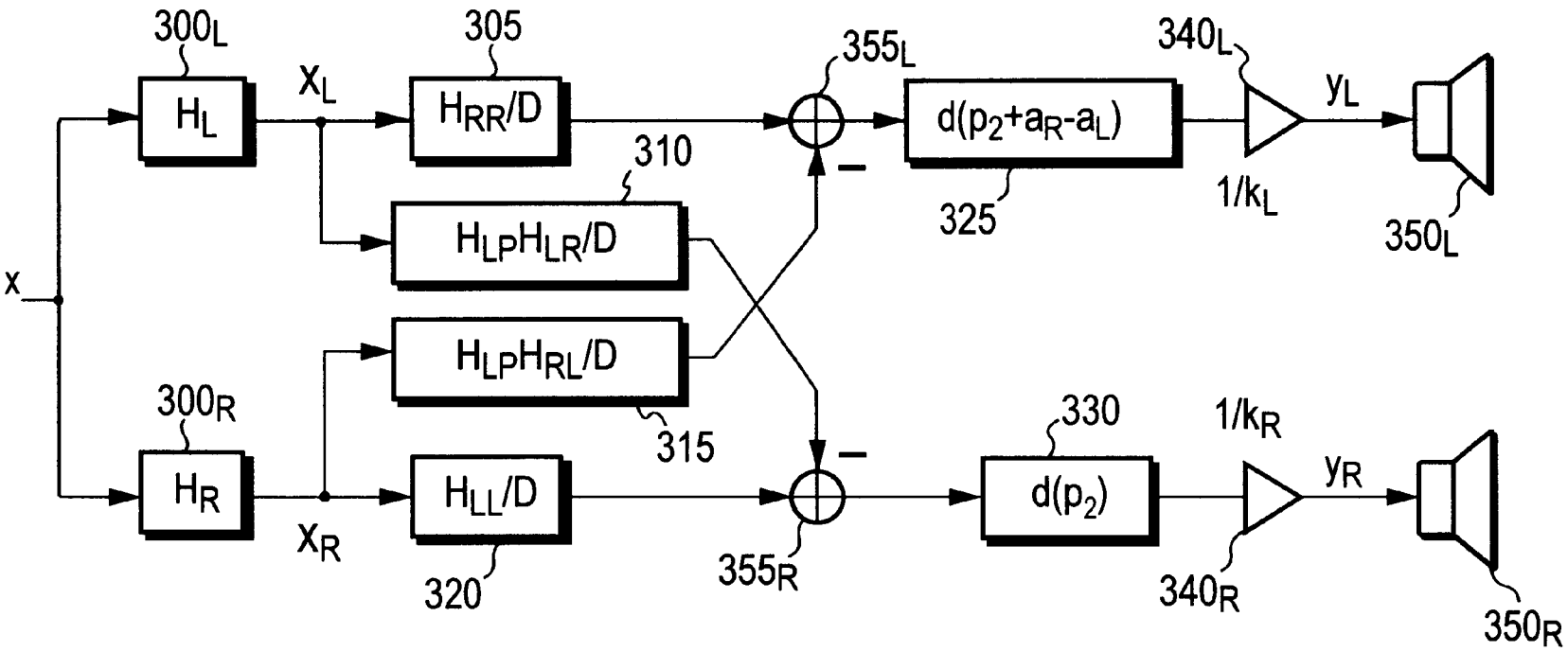
FIG. 14 schematically illustrates the feedforward implementation of the invention.

Another alternative to the implementation shown in FIG. 5 is the "feedforward" approach illustrated in FIG. 14, which utilizes the lowpass-filtered inverse head-transfer matrix of Eq. 16. This implementation includes means for receiving an input signal x; a pair of right-channel and left-channel HRTF filters $\mathbf{300}_L$, $\mathbf{300}_R$, respectively; a series of feedforward lowpass crosstalk-cancellation filters 305, 310, 315, 320; a variable delay line 325 (with $P_2$, $a_R$, and $a_L$ defined as above); a fixed delay line 330; and a pair of vari20 able gains (amplifiers) $\mathbf{340}_L$, $\mathbf{340}_R$. The determinant term of the crosstalk-cancellation filters is $$D = \frac{1}{H_{LL}H_{RR} - H_{LP}^2 H_{LR}H_{RL}},$$

where $H_{LP}$ is the lowpass term; and once again, the variable delay line and the variable gains compensate for asymmetric path lengths to the head. A pair of negative adders $\mathbf{355}_L$, $\mathbf{355}_R$ negatively mix, respectively, the output of filter 315 with that of filter 305, and the output of filter 310 and with that of filter 320. The result is a pair of speaker signals $Y_L$, $Y_R$ that drive respective loudspeakers $\mathbf{350}_L$, $\mathbf{350}_R$.

Each of the feedforward filters may be implemented using an FIR filter, and module 130 can straightforwardly interpolate between stored filter parameters (each corresponding to a particular listening geometry) as the listener's head moves. The filters themselves are readily designed using inverse filter-design techniques based on the discrete Fourier transform (DFT). At a 32 kHz sampling rate, for example, an FIR length of 128 points (4 msec) yields satisfactory performance. FIR filters of this length can be efficiently computed using DFT convolution. Per channel, it is necessary to compute one forward and one inverse DFT, along with two spectral products and one spectral addition.

c. High-Frequency Power Transfer

As discussed above, the bandlimited crosstalk canceller of Eq. 16 continues to implement ipsilateral equalization at high frequencies (see Eq. 17), since the ipsilateralequalization filters are not similarly bandlimited. Thus when a sound is panned to the location of either speaker, the response to the speaker will be flat; this is because the ipsilateral equalization exactly inverts the ipsilateral binaural synthesis response, an operation in agreement with the power-panning property. The other speaker, however, emits the contralateral binaural response, which violates the power-panning property. Of course, if crosstalk cancellation were not bandlimited and extended to high frequencies, the contralateral response would be internally cancelled and would not appear at the contralateral loudspeaker. Unfortunately, for the reasons described earlier, crosstalk cancellation causes more harm than benefit at high frequencies. To optimize the presentation of high frequencies while satisfying the power-panning property, the invention maintains bandlimited crosstalk cancellation (operative, preferably, below 6 kHz) and alters the high frequencies only in terms of power transfer (rather than phase, e.g., by subtracting a cancellation signal derived from the contralateral channel).

In accordance with this aspect of the invention, high-frequency power output at each speaker is modified so that the listener experiences power ratios consistent with his position and orientation. In other words, high-frequency gains are established so as to minimize the interfering effects of crosstalk. This is accomplished with a single gain parameter per channel that affects the entire high-frequency band (preferably 6 kHz–20 kHz).

Based on the assumption that high-frequency signals from the two speakers add incoherently at the ears, the invention models the high-frequency power transfer from the speakers to the ears as a 2×2 matrix of power gains derived from the HRTFs. (An implicit assumption for purposes hereof is that KEMAR head shadowing is similar to the head shadowing of a typical human.) The power-transfer matrix is inverted to calculate what powers to send to the speakers in order to obtain the proper power at each ear. Often it is not possible to synthesize the proper powers, e.g., for a right-side source that is more lateral than the right loudspeaker. In this case the desired "interaural level difference" (ILD) is greater than that achieved by sending the signal only to the right loudspeaker. Any power emitted by the left loudspeaker will decrease the final ILD at the ears. In such cases, where no exact solution exists, the invention sends the signal to one speaker, scaling its power such that the total power transfer to the two ears equals the total power in the synthesis HRTFs. Except for this caveat, the power-transfer approach is entirely analogous to the correction obtained by crosstalk cancellation. If it is omitted, very little happens to the high frequencies when the listener rotates his head. The power-transfer model of the present invention enhances dynamic localization by extending correction to these frequencies, helping to align the high-frequency ILD cue with the low-frequency localization cues while maintaining the power-panning property and avoiding the distortions associated with high-frequency crosstalk cancellation.

The high-frequency power to each speaker is controlled by associating a multiplicative gain with each output channel. Because the crosstalk-cancellation filter is diagonal at high frequencies, the scaling gains can be commuted to the synthesis HRTFs. Combining previous equations, the ear signals at high frequencies for a source x are given by:

$$\begin{bmatrix} e_L \\ e_R \end{bmatrix} = \begin{bmatrix} H_{LL} & H_{RL} \\ H_{LR} & H_{RR} \end{bmatrix} \begin{bmatrix} g_L H_L / H_{LL} \\ g_R H_R / H_{RR} \end{bmatrix} x \quad \text{(Eq. 31)}$$

where $g_L$, $g_R$ are the high-frequency scaling gains. This equation may be converted to an equivalent expression in terms of power transfer. The simplest approach is to model the input signal x as stationary white noise and to assume that the transfer functions to the two ears are uncorrelated. Rewriting Eq. 31 in terms of signal variance by replacing the transfer functions with their corresponding energies, $$\begin{bmatrix} \sigma_{e_L}^2 \\ \sigma_{e_R}^2 \end{bmatrix} = \begin{bmatrix} E_{H_{LL}} & E_{H_{RL}} \\ E_{H_{LR}} & E_{H_{RR}} \end{bmatrix} \begin{bmatrix} g_L^2 E_{H_L} / E_{H_{LL}} \\ g_R^2 E_{H_R} / E_{H_{RR}} \end{bmatrix} \sigma_x^2 \quad \text{(Eq. 32)}$$

where the energy of a discrete-time signal h[i], with corresponding DFT H[k], is given by:

$$E_h = \sum_{i=0}^{N-1} h^2[i] = \frac{1}{N} \sum_{k=0}^{N-1} |H[k]|^2 \quad \text{(Eq. 33)}$$

The power transfer to the ears is then:

$$\begin{bmatrix} \sigma_{e_L}^2 / \sigma_x^2 \\ \sigma_{e_R}^2 / \sigma_x^2 \end{bmatrix} = \begin{bmatrix} E_{H_{LL}} & E_{H_{RL}} \\ E_{H_{LR}} & E_{H_{RR}} \end{bmatrix} \begin{bmatrix} g_L^2 E_{H_L} / E_{H_{LL}} \\ g_R^2 E_{H_R} / E_{H_{RR}} \end{bmatrix} \quad \text{(Eq. 34)}$$

Replacing the actual power transfer to the ears with the desired power transfer corresponding to the synthesis HRTFs and solving for the scaling gains, $$\begin{bmatrix} E_{H_L} \\ E_{H_R} \end{bmatrix} = \begin{bmatrix} E_{H_{LL}} & E_{H_{RL}} \\ E_{H_{LR}} & E_{H_{RR}} \end{bmatrix} \begin{bmatrix} g_L^2 E_{H_L} / E_{H_{LL}} \\ g_R^2 E_{H_R} / E_{H_{RR}} \end{bmatrix} \quad \text{(Eq. 35)}$$

$$\begin{bmatrix} g_L^2 \\ \sigma_R^2 \end{bmatrix} = \begin{bmatrix} E_{H_{LL}} / E_{H_L} & 0 \\ 0 & E_{H_{RR}} / E_{H_R} \end{bmatrix} \begin{bmatrix} E_{H_{LL}} & E_{H_{RL}} \\ E_{H_{LR}} & E_{H_{RR}} \end{bmatrix}^{-1} \begin{bmatrix} E_{H_L} \\ E_{H_R} \end{bmatrix} \quad \text{(Eq. 36)}$$

Eq. 32 is the crosstalk-cancellation filter function expressed in terms of broadband power transfer. If either row of the righthand side of Eq. 36 is negative, then a real solution is not obtainable. In this case, the gain corresponding to the negative row is set to zero, and the other gain term is set such that the total power to the ears is equal to the total desired power. The expression relating total desired power and total power follows directly from Eq. 31 by adding the two rows:

$$E_{H_L} + E_{H_R} = g_L^2 \frac{E_{H_L}}{E_{H_{LL}}} (E_{H_{LL}} + E_{H_{LR}}) + g_R^2 \frac{E_{H_R}}{E_{H_{RR}}} (E_{H_{RL}} + E_{H_{RR}}) \quad \text{(Eq. 37)}$$

This expression is solved for one gain when the other gain is set to zero. Because all energies are non-negative, a real solution is assured.

In practice, it is found that the high-frequency model achieves only modest improvements over unmodified binaural signals for symmetric listening situations. However, the high-frequency gain modification is very important when the listener's head is rotated; without such modification, the low- and high-frequency components will be synthesized at different locations-the low frequencies relative to the head, and the high frequencies relative to the speakers.

Figure 15:
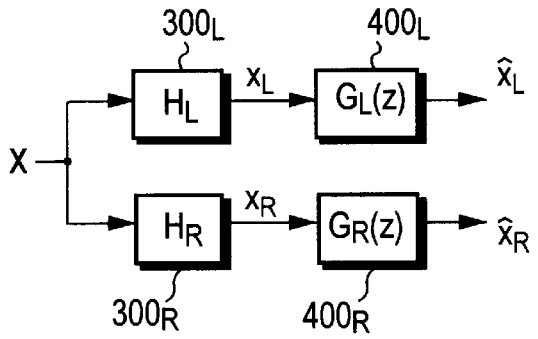
FIG. 15 shows the addition of a shelving filter to implement high-frequency compensation for crosstalk.

High-frequency power compensation through gain modification can be implemented by creating a set of HRTFs with high-frequency responses scaled as set forth above, each HRTF being tailored for a particular listening geometry (requiring, in effect, a separate set of synthesis HRTFs for each orientation of the head with respect to the speakers). However, scaling the high-frequency components of the synthesis HRTFs in this manner corresponds exactly to applying a high-frequency shelving filter to each channel of the binaural source. (It is of course theoretically possible to divide the high-frequency bands into finer and finer increments, the limit of which is a continuous high-frequency equalization filter.) Using a shelving filter that operates on each channel of each binaural source, it is only the filter gains—rather than the synthesis HRTFs—that need be updated as the listener moves. Accordingly, a pre-computed set of gains $g_L$ and $g_R$ are established for numerous combinations of listening geometries and source locations, and stored in a database format for realtime retrieval and application. For example, as shown in FIG. 15, the implementation illustrated in FIG. 14 can be modified by adding a shelving filter $\mathbf{400}_L$, $\mathbf{400}_R$ between the HRTF filters $\mathbf{300}_L$, $\mathbf{300}_R$ and the crosstalk-cancellation filters 305, 310, 315, 320; in effect, filters $\mathbf{400}_L$, $\mathbf{400}_R$ transform the HRTF output signals $x_L$, $x_R$ into high-frequency-adjusted signals $\hat{x}_L$, $\hat{x}_R$. The shelving filters $\mathbf{400}_L$, $\mathbf{400}_R$ have the same low-frequency phase and magnitude responses independent of the high-frequency gains.

Figure 16A:
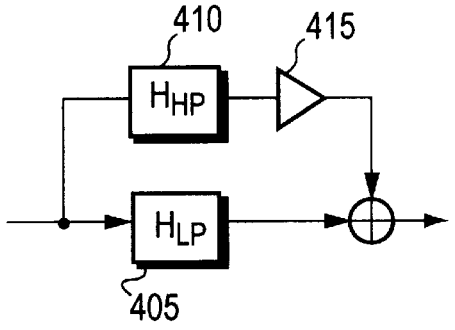
FIGS. 16A, 16B illustrate practical implementations for the shelving filters illustrated in FIG. 15.
Figure 16B:
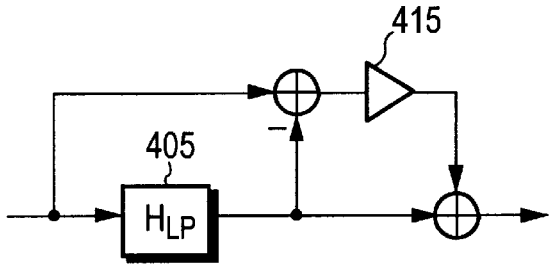

Practical implementations for shelving filters $\mathbf{400}_L$, $\mathbf{400}_R$ are shown for a single channel in FIGS. 16A and 16B. In FIG. 16B, the lowpass filter 405 preferably passes frequencies below 6 kHz, while highpass filter 410 feeds the high-frequency signals above 6 kHz to a variable gain element 415, which implements the high-frequency gain $g_x$.

Figure 17:
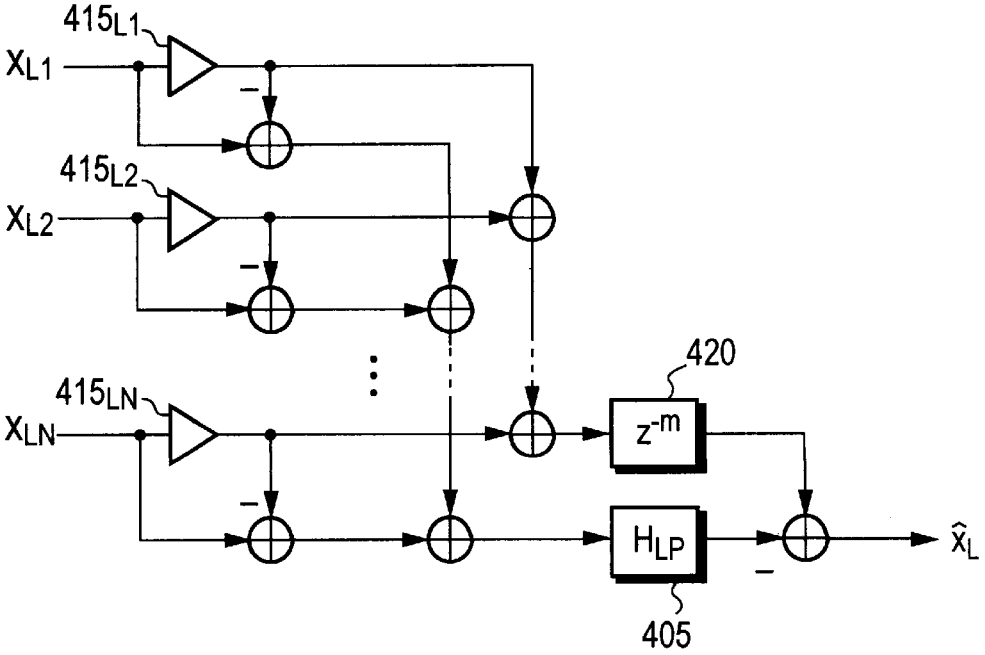
FIG. 17 depicts a working circuit implementing high-frequency compensation for crosstalk.

When $H_{LP}$ and $H_{HP}$ have complementary responses, $H_{LP}(z)=1-H_{LP}(z)$, and this condition faciliates use of the simplified arrangement depicted in FIG. 16B. Unfortunately, it is not possible to use a low-order IIR lowpass filter for $H_{LP}$ because the low-frequency phase response of the shelving filter will depend on the high-frequency gain. Accordingly, a zero-phase FIR filter is used for $H_{LP}$. Although this adds considerable computation, only one lowpass filter per channel is necessary to implement independent shelving filters for any number of sources, as shown in FIG. 17. This design is based on the following relationships implicit in FIG. 16B:

$$\hat{x}_i=g_i(1-H_{LP})x_i+H_{LP}x_i$$

$$\hat{x}_i=g_ix_i-H_{LP}x_i(1+g_i) \qquad \text{(Eq. 38)}$$

FIG. 17 depicts a working circuit for a single (left) channel having multiple input sources. In particular, $x_{Li}$ is the left-channel binaural signal for source i; the filters $\mathbf{415}_{Li}$ . . . $\mathbf{415}_{LN}$ each implement a value of $g_{Li}$, the left-channel high-frequency scaling gain for source i; $\hat{x}_{Li}$ is the high-frequency-adjusted left-channel binaural signal; and the delay 420 implements a linear phase delay to match the delay of lowpass filter 405. The same circuit is used for the right channel, and the resulting high-frequency-adjusted binaural signals $\hat{x}_{Li}$, $\hat{x}_{Ri}$ are routed to the crosstalk-canceller inputs.

It will therefore be seen that the foregoing represents a versatile approach to three-dimensional audio that accommodates listener movement without loss of imaging or sound fidelity. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for generating binaural audio for a moving listener, the apparatus comprising:

a. means for tracking movement of a listener's head; and b. means, responsive to the tracking means, for generating a movement-responsive binaural signal for broadcast to the moving listener through a pair of non-head-mounted loudspeakers, the signal-generating means comprising (i) means for receiving an input signal, (ii) first and second means for receiving the input signal and generating therefrom first and second binaural signals, respectively, and (iii) crosstalk cancellation means, responsive to the tracking means for receiving the first and second binaural signals and adding thereto a crosstalk cancellation signal, the crosstalk cancellation signal being based on position of the listener's head so as to compensate for head movement.

2. The apparatus of claim 1 wherein the crosstalk cancellation means comprises first and second head-shadowing filters for modeling phase and amplitude alteration of the crosstalk signal due to head diffraction.

3. The apparatus of claim 2 wherein the crosstalk cancellation means further comprises first and second ipsilateral equalization filters for compensating for position of the loudspeakers.

4. The apparatus of claim 2 wherein the crosstalk cancellation means further comprises at least one variable time delay for compensating for different path lengths from a pair of loudspeakers to the listener.

5. The apparatus of claim 2 wherein the head-shadowing filters are lowpass filters.

6. The apparatus of claim 5 wherein the head-shadowing filters comprise low-order infinite impulse response filters.

7. The apparatus of claim 4 wherein the at least one variable time delay comprises a low-order finite-impulse response interpolator.

8. The apparatus of claim 1 wherein the tracking means detects a position and a rotation angle of the listener's head, the crosstalk cancellation means comprising:

a. a series of filters, each filter being matched to a head position and a head rotation angle, for generating a crosstalk cancellation signal;

b. selection means, responsive to the tracking means, for selecting a filter to receive the first and second binaural signals.

9. The apparatus of claim 8 wherein selection means further comprises interpolation means, the selection means identifying at least two filters associated with head positions and head rotation angles closest to the position and rotation angle detected by the tracking means, the interpolation means generating an intermediate filter based on the identified filters.

10. The apparatus of claim 1 wherein the signal-generating means comprises:

a. means for receiving an input signal;

b. first and second means for receiving the input signal and generating therefrom first and second binaural signals, respectively, the binaural signals each (i) corresponding to a synthesized source having an apparent spatial position and (ii) having high-frequency components with power levels;

c. means for varying the power levels of the high-frequency component to compensate for crosstalk.

11. The apparatus of claim 10 wherein the power-varying means comprises, for each binaural signal, a. at least one shelving filter having a high-frequency gain; and b. means, responsive to the tracking means, for establishing the high-frequency gain of the shelving filter.

12. The apparatus of claim 10 wherein the tracking means detects a position and a rotation angle of the listener's head, the establishing means establishing the high-frequency gain based on the head position, the rotation angle and the position of the synthesized source.

13. The apparatus of claim 10 wherein the high-frequency component includes frequencies above 6 kHz.

14. The apparatus of claim 11 wherein the shelving filters have identical low-frequency phase and magnitude response independent of high-frequency gain.

15. The apparatus of claim 10 wherein the binaural signals further comprise low-frequency components, the apparatus further comprising crosstalk cancellation means, responsive to the tracking means, for receiving the first and second binaural signals and adding to the low-frequency components thereof a crosstalk cancellation signal, the crosstalk cancellation signal being based on position of the listener's head so as to compensate for head movement.

16. The apparatus of claim 15 wherein the crosstalk cancellation means comprises first and second head-shadowing filters for compensating for phase and amplitude alteration of the crosstalk signal due to head diffraction.

17. Apparatus for generating binaural audio for a listener, the apparatus comprising:

a. means for detecting (i) a position of a listener's head with respect to a pair of non-head-mounted loudspeakers, the position comprising a distance from each loudspeaker, and (ii) an orientation of the listener's head, the orientation comprising a head-rotation angle; and b. means, responsive to the tracking means, for generating a movement-responsive binaural signal for broadcast to the listener through the loudspeakers, the signal-generating means comprising (i) means for receiving an input signal, (ii) first and second means for receiving the input signal and generating therefrom first and second binaural signals, respectively, and (iii) crosstalk cancellation means, responsive to the tracking means, for receiving the first and second binaural signals and adding thereto a crosstalk cancellation signal, the crosstalk cancellation signal being based on the position and the orientation of the listener's head so as to compensate for head movement.

18. The apparatus of claim 17 wherein the crosstalk cancellation means comprises first and second head-shadowing filters for modeling phase and amplitude alteration of the crosstalk signal due to head diffraction.

19. The apparatus of claim 18 wherein the crosstalk cancellation means further comprises first and second ipsilateral equalization filters for compensating for position of the loudspeakers.

20. The apparatus of claim 18 wherein the crosstalk cancellation means further comprises at least one variable time delay for compensating for different path lengths from a pair of loudspeakers to the listener.

21. The apparatus of claim 18 wherein the head-shadowing filters are lowpass filters.

22. The apparatus of claim 21 wherein the head-shadowing filters comprise low-order infinite impulse response filters.

23. The apparatus of claim 20 wherein the at least one variable time delay comprises a low-order finite-impulse response interpolator.

24. The apparatus of claim 17 wherein the crosstalk cancellation means comprises:

a. a series of filters, each filter being matched to a head position and a head rotation angle, for generating a crosstalk cancellation signal;

b. selection means, responsive to the tracking means, for selecting a filter to receive the first and second binaural signals.

25. The apparatus of claim 24 wherein selection means further comprises interpolation means, the selection means identifying at least two filters associated with head positions and head rotation angles closest to the position and rotation angle detected by the tracking means, the interpolation means generating an intermediate filter based on the identified filters.

26. The apparatus of claim 17 wherein the signal-generating means comprises:

a. means for receiving an input signal;

b. first and second means for receiving the input signal and generating therefrom first and second binaural signals, respectively, the binaural signals each (i) corresponding to a synthesized source having an apparent spatial position and (ii) having high-frequency components with power levels;

c. means for varying the power levels of the high-frequency component to compensate for crosstalk.

27. The apparatus of claim 26 wherein the power-varying means comprises, for each binaural signal, a. at least one shelving filter having a high-frequency gain; and b. means, responsive to the tracking means, for establishing the high-frequency gain of the shelving filter.

28. The apparatus of claim 26 wherein the establishing means establishes the high-frequency gain based on the head position, the head orientation and the position of the synthesized source.

29. The apparatus of claim 26 wherein the high-frequency component includes frequencies above 6 kHz.

30. The apparatus of claim 27 wherein the shelving filters have identical low-frequency phase and magnitude response independent of high-frequency gain.

31. The apparatus of claim 26 wherein the binaural signals further comprise low-frequency components, the apparatus further comprising crosstalk cancellation means, responsive to the tracking means, for receiving the first and second binaural signals and adding to the low-frequency components thereof a crosstalk cancellation signal, the crosstalk cancellation signal being based on position of the listener's head so as to compensate for head movement.

32. The apparatus of claim 31 wherein the crosstalk cancellation means comprises first and second head-shadowing filters for modeling phase and amplitude alteration of the crosstalk signal due to head diffraction.

33. Apparatus for generating binaural audio without high-frequency crosstalk, the apparatus comprising:

a. means for generating a binaural signal for broadcast through a pair of loudspeakers;

b. first and second means for receiving the input signal and generating therefrom first and second binaural signals, respectively, the binaural signals each (i) corresponding to a synthesized source having an apparent spatial position and (ii) having high-frequency components with power levels; and c. means for varying the power levels of the high-frequency component to compensate for crosstalk.

34. The apparatus of claim 33 wherein the power-varying means comprises, for each binaural signal, a. at least one shelving filter having a high-frequency gain; and b. means for establishing the high-frequency gain of the shelving filter.

35. The apparatus of claim 33 further comprising means for tracking a position and a rotation angle of a listener's head, the establishing means establishing the high-frequency gain based on the head position, the rotation angle and the position of the synthesized source.

36. The apparatus of claim 33 wherein the high-frequency component includes frequencies above 6 kHz.

37. The apparatus of claim 34 wherein the shelving filters have identical low-frequency phase and magnitude response independent of high-frequency gain.

38. The apparatus of claim 33 wherein the binaural signals further comprise low-frequency components, the apparatus further comprising crosstalk cancellation means, responsive to the tracking means, for receiving the first and second binaural signals and adding to the low-frequency components thereof a crosstalk cancellation signal, the crosstalk cancellation signal being based on position of the listener's head so as to compensate for head movement.

39. The apparatus of claim 38 wherein the crosstalk cancellation means comprises first and second head-shadowing filters for modeling phase and amplitude alteration of the crosstalk signal due to head diffraction.

40. A method of generating binaural audio for a moving listener, the method comprising the steps of:

a. tracking movement of a listener's head; and b. generating, in response to the tracked movement, a movement-responsive binaural signal for broadcast to the moving listener through a pair of non-head-mounted loudspeakers.

41. A method of generating binaural audio for a listener, the method comprising the steps of:

a. detecting (i) a position of a listener's head with respect to a pair of non-head-mounted loudspeakers, the position comprising a distance from each loudspeaker, and (ii) an orientation of the listener's head, the orientation comprising a head-rotation angle; and b. generating, in response to the detected position, a movement-responsive binaural signal for broadcast to the listener through the loudspeakers, the signal containing a crosstalk-cancellation component.

42. A method of generating binaural audio without high-frequency crosstalk, the method comprising the steps of:

a. generating a binaural signal for broadcast through a pair of loudspeakers;

b. receiving the input signal and generating therefrom first and second binaural signals, respectively, the binaural signals each (i) corresponding to a synthesized source having an apparent spatial position and (ii) having high-frequency components with power levels; and c. varying the power levels of the high-frequency component to compensate for crosstalk.

* * * * *